US005908004A

United States Patent [19]

Porter et al.

[11] Patent Number: 5,908,004

[45] Date of Patent: Jun. 1, 1999

[54] METHOD AND APPARATUS FOR MANIPULATING AND SEWING FLEXIBLE FABRICS

[75] Inventors: Michael R. Porter, Topsfield, Mass.; Steven Marcangelo, Derry, N.H.; John J. Kirby, South Hamilton; Charles E. Mulcahey, Beverly, both of Mass.

[73] Assignee: Porter Sewing Machines, Inc., Beverly, Mass.

[21] Appl. No.: 08/656,345

[22] PCT Filed: Mar. 17, 1995

[86] PCT No.: PCT/US95/03283

§ 371 Date: Jun. 14, 1996

§ 102(e) Date: Jun. 14, 1996

[87] PCT Pub. No.: WO95/25194

PCT Pub. Date: Sep. 21, 1995

Related U.S. Application Data

[63] Continuation-in-part of application No. 08/210,881, Mar. 17, 1994, Pat. No. 5,529,004.

[51] Int. Cl.[6] ..... D05B 21/00

[52] U.S. Cl. ..... 112/470.07; 112/470.12; 112/150; 112/306; 112/309; 112/475.04

[58] Field of Search ..... 112/470.07, 470.03, 112/470.06, 2.1, 306, 309, 308, 318, 320, 322, 475.03, 475.04, 475.05, 475.08, 470.12, 470.13

[56] References Cited

U.S. PATENT DOCUMENTS

| | | | |
|---|---|---|---|
| 1,947,058 | 4/1934 | Pittoni . | |
| 3,013,513 | 12/1961 | Judelson . | |
| 3,109,398 | 11/1963 | Abramowicz | 112/235 X |
| 3,371,630 | 3/1968 | Cash, Jr. | 112/470.12 |
| 3,511,200 | 5/1970 | Howell et al. | 112/235 |
| 4,043,282 | 8/1977 | Fanghanel . | |
| 4,067,269 | 1/1978 | Fanghanel . | |
| 4,141,304 | 2/1979 | Masuda . | |
| 4,276,842 | 7/1981 | Torre | 112/235 X |
| 4,498,404 | 2/1985 | Sadeh . | |
| 4,691,651 | 9/1987 | Junemann | 112/470.13 X |
| 4,742,789 | 5/1988 | Pestel et al. . | |
| 4,776,579 | 10/1988 | Romand et al. | 112/470.07 X |
| 4,794,873 | 1/1989 | Dordi et al. . | |
| 4,813,364 | 3/1989 | Boser . | |
| 4,821,656 | 4/1989 | Dordi et al. . | |
| 4,825,787 | 5/1989 | Babson et al. . | |
| 4,827,856 | 5/1989 | Rohr . | |
| 4,838,186 | 6/1989 | Resta et al. . | |

(List continued on next page.)

FOREIGN PATENT DOCUMENTS

| | | |
|---|---|---|
| 220368 | 5/1987 | European Pat. Off. . |
| 0264618A1 | 4/1988 | European Pat. Off. . |
| 0330285A1 | 8/1989 | European Pat. Off. . |
| 1567893 | 5/1969 | France . |
| 3139426 | 4/1983 | Germany . |
| 3712493 | 11/1987 | Germany . |
| 7-308465 | 11/1995 | Japan . |
| 1384073 | 2/1975 | United Kingdom . |
| WO92/12282 | 7/1992 | WIPO . |

OTHER PUBLICATIONS

Yamaichi Tape Binding and Sewing Robot System (date unknown).

*Primary Examiner*—Peter Nerbun
*Attorney, Agent, or Firm*—Wolf, Greenfield & Sacks, P.C.

[57] ABSTRACT

Sewing apparatus for joining a first panel and a second panel and having an arm that is rotated about an axis normal to the surface of the first panel to rotate the first panel, a shoe biased to follow an edge of the first panel as the first panel is fed to the sewing machine, a detector to monitor the shoe and provide a signal indicative of a longitudinal orientation of the edge of the first panel, and means for adjusting the longitudinal orientation of the first panel with respect to a true feed direction in response to the longitudinal orientation signal. An edge flattener including a generally cylindrical component is provided.

21 Claims, 25 Drawing Sheets

U.S. PATENT DOCUMENTS

| | | | |
|---|---|---|---|
| 4,905,615 | 3/1990 | Pofferi . | |
| 4,958,579 | 9/1990 | De Weers . | |
| 5,103,747 | 4/1992 | Resta et al. | 112/470.13 X |
| 5,289,788 | 3/1994 | Fukumoto . | |
| 5,335,612 | 8/1994 | Cizek et al. | 112/235 |
| 5,367,968 | 11/1994 | Diaz . | |
| 5,529,004 | 6/1996 | Porter et al. . | |
| 5,560,308 | 10/1996 | Eto | 112/470.07 |

METHOD AND APPARATUS FOR MANIPULATING AND SEWING FLEXIBLE FABRICS

CROSS REFERENCE TO RELATED APPLICATION

This application is a continuation-in-part of U.S. application Ser. No. 08/210,881 filed Mar. 17, 1994, now U.S. Pat. No. 5,529,004 and entitled METHOD AND APPARATUS FOR MANIPULATING FLEXIBLE FABRICS.

FIELD OF THE INVENTION

This invention relates to a method and apparatus for manipulating a flexible fabric and, more particularly, to a machine that manipulates a top panel of a mattress sack so that all edges thereof may be automatically joined to a side panel.

BACKGROUND OF THE INVENTION

Modern mattresses generally include an inner construction and a mattress sack that completely covers the inner construction. The sack is secured to the inner construction by means of a flange which is connected to the inner construction using hog rings or the like.

The ticking material of a mattress sack may be of many types, such as flat or quilted, and the sack generally includes identical top and bottom panels and a side panel, joining the top and bottom panels. The top and bottom panel may be sewn directly to the side panel, joined with boarder tape, or attached with a gusset.

To reduce manufacturing cost, attempts have been made to automatically attach the side panel to the top panel. Typically, these attempts have held the inner construction stationary on a table and have positioned the mattress sack over the inner construction. A self-propelled sewing machine then joins the side and top panel, by boarder tape for example, by moving around the table via a track mechanism. Many modifications to this basic structure have been made and will not be repeated here for the sake of brevity.

More recently, the basic principle of propelling the sewing machine around the mattress has been reversed: now, the mattress is moved, not the sewing machine. For example, U.S. Pat. No. 4,043,282 describes a mattress tape edge closing machine, in which the mattress and cover are lifted at an angle with respect to a stationary machine. The mattress is then moved past the machine. In addition, U.S. Pat. No. 4,838,186 describes a sewing machine, including presser elements rotatably supported about a vertical axis to allow rotation of the mattress sack. Furthermore, U.S. Pat. No. 4,958,579 describes a device for sewing the edges of a mattress cover on an inner construction, including a swingable arm for rotating the mattress construction.

Some of these machines are cumbersome because they operate on the entire mattress construction. Others have difficulty maintaining high quality "sizing", a necessity in the mattress field. "Sizing" is a term known in the art and is used to refer to the uniformity of a mattress's stitching and dimensions, and more generally to its appearance.

Those skilled in the art will appreciate that a low cost and reliable machine for forming mattress sacks is needed.

Therefore, it is an object of the invention to provide a low cost machine for manipulating flexible fabrics, yet maintaining high quality sizing.

It is a further object of the invention to provide a method and apparatus for manipulating mattress sacks and other flexible fabrics, such that the feeding of the material to the apparatus is automatically monitored and corrected to insure high quality sizing.

It is yet another object of the present invention to prepare the panel to ensure that panel filling does not protrude from the ticking layer.

SUMMARY OF THE INVENTION

These and other objects are achieved with a method and apparatus for manipulating flexible fabrics, such as a top panel of a mattress sack. The invention works in conjunction with a conventional sewing machine, which is used to join the top panel and a side panel. The joining process may be of several types, including directly sewing together the two panels and a flange, joining the two panels and a flange with border tape, or joining the two panels and a flange with a gusset. In each case, the conventional sewing machine used must have the necessary apparatus for receiving and joining the side panel and other joining materials, e.g., border tape. Certain modifications are made to the conventional machine, which will be described below.

A top panel is pulled along a work surface by the feeding mechanism of the sewing machine. In one embodiment, a pair of sleds with automatically actuated clamps assists in positioning and advancing the top panel along the work surface. An edge of the top panel is joined to an edge of the side panel by known techniques. This joining proceeds along the entire length of the edge. The invention then detects an end of the edge and automatically manipulates the top panel so that a subsequent edge may be joined.

One aspect of the invention includes a detector to detect when the end of the edge that is being joined is a fixed distance from the needle of the sewing machine. At such time, the invention sends an indicative signal to the sewing machine so that it may slow the stitching speed during the manipulation of the panel.

Another aspect of the invention includes a pivot arm that is lowered into engagement with the top panel proximal to the sewing machine. The pivot arm engages the top panel near a corner thereof, about which point of contact the panel is rotated. Preferably, it includes a bearing mechanism to allow easy rotation.

Another aspect includes a detector to detect when an end of the edge of the top panel that is being joined is a second fixed distance from the needle. A controller receives a signal from the detector and causes a mover arm to engage the top panel. The arm is then rotated, which causes the panel to rotate. In one embodiment, the mover arm presses on the top surface of the top panel at a location spaced from an edge of the top panel. In another embodiment, the mover arm includes an automatically actuated clamp and a sensor for detecting an edge of the top panel, and the mover arm grabs the edge and pulls the top panel to pivot it about the pivot arm. Upon completion of the rotation, a subsequent edge of the top panel is positioned ready for subsequent joining with a remaining portion of the side panel.

To ensure that the top panel is being received properly, another aspect of the invention includes an orientation detector mechanism for detecting the longitudinal orientation of the edge of the top panel that is being joined with the side panel. The orientation detector provides a signal, indicative of the orientation of the top panel, to the controller.

A correction wheel is used in conjunction with the orientation detector to properly align the top panel. The correction wheel is transversely spaced from the sewing needle relative to the feeding direction of the sewing machine. The correction wheel includes a receiving wheel that engages the top panel and pulls the top panel toward the sewing machine in conjunction with the feeding mechanism of the sewing machine and in synchronism with the sewing machine. The speed of the receiving wheel is modifiable under the control of the controller.

The controller coordinates the operation of the correction wheel, relative to the orientation of the top panel. If the .controller receives a signal from the orientation detector, indicating that the edge of the top panel is misoriented with respect to a "true direction," the controller may either speed up or slow down the speed of the receiving wheel. The torque that results from the receiving wheel operating at a speed different than that of the feeding mechanism of the sewing machine causes the top panel to rotate. Thus, by modifying the speed of the receiving wheel, the controller can cause the panel to be moved into alignment.

To ensure that the sewn edges will not be bunched, another aspect of the invention includes a fabric flattener for urging fill within the top panel toward a cut edge of the top panel. The flattener is positioned prior to the sewing needle and has a helical shape with the narrowest portion positioned inwardly, toward the center of the top panel. The flattener engages the top panel and rotates, causing the helical shape to urge the fill outwardly.

The flattener works in conjunction with a panel cutter placed transversely with respect to the sewing needle. The panel cutter works in timed relation with the needle such that, as the needle joins the materials, the panel cutter cuts the materials a fixed distance from the needle. This cutting operation provides uniform sizing by ensuring that the materials are joined at a fixed distance from the cut edge. The panel cutter also ensures that any protruding fill, resulting from the flattener, is also cut. The panel cutter, however, does not require the presence of the flattener, and may be used without it.

To ensure a clean-cut of the flange, another aspect of the invention includes a flange cutter for cutting the flange transversely at the end of the application.

The present invention also relates to a method for joining the top panel and side panel, which includes the following steps: (a) feeding a top panel to a sewing machine; (b) feeding a side panel to the sewing machine; (c) sewing an edge of the top panel to an edge of the side panel; (d) detecting a corner of the top panel; and (e) in response to detecting the corner, rotating the top panel so that a subsequent edge of the top panel may be sewn to the edge of the side panel. This method may also include further aspects, such as the following: detecting the longitudinal orientation of the top panel with respect to a true direction; and correcting the orientation of the top panel to be in alignment with the true direction.

BRIEF DESCRIPTION OF THE DRAWING

The invention will be more fully appreciated from the following detailed description when taken in conjunction with accompanying drawings, in which.

DETAILED DESCRIPTION

The present invention relates to a method and apparatus for manipulating a flexible material, such as a top panel of a mattress sack, so that all edges of the top panel may be automatically joined to a second material, such as a flange. A conventional sewing machine, with certain modifications, as described below, is used to join the top and side panels. The sewing machine receives the fabrics with appropriate feeding mechanisms for the material to be joined. The invention senses when the end of the edge of the top panel that is being joined is a fixed distance from the sewing machine needle. The invention then causes the sewing machine to slow the stitching speed. After the panel has moved a second fixed distance, the invention then causes a pivot arm to engage the panel and the invention then causes a mover arm to engage the top panel and rotate. Consequently, the top panel is rotated, with a subsequent edge of the top panel ready to be joined. The conventional sewing machine may be programmed to count stitches to determine when all edges of the top panel are completely joined to the second material. Though the description refers to panels used in constructing mattress sacks, the invention may also be used in the production of other flexible fabric products, such as bedspreads.

Figure 8:
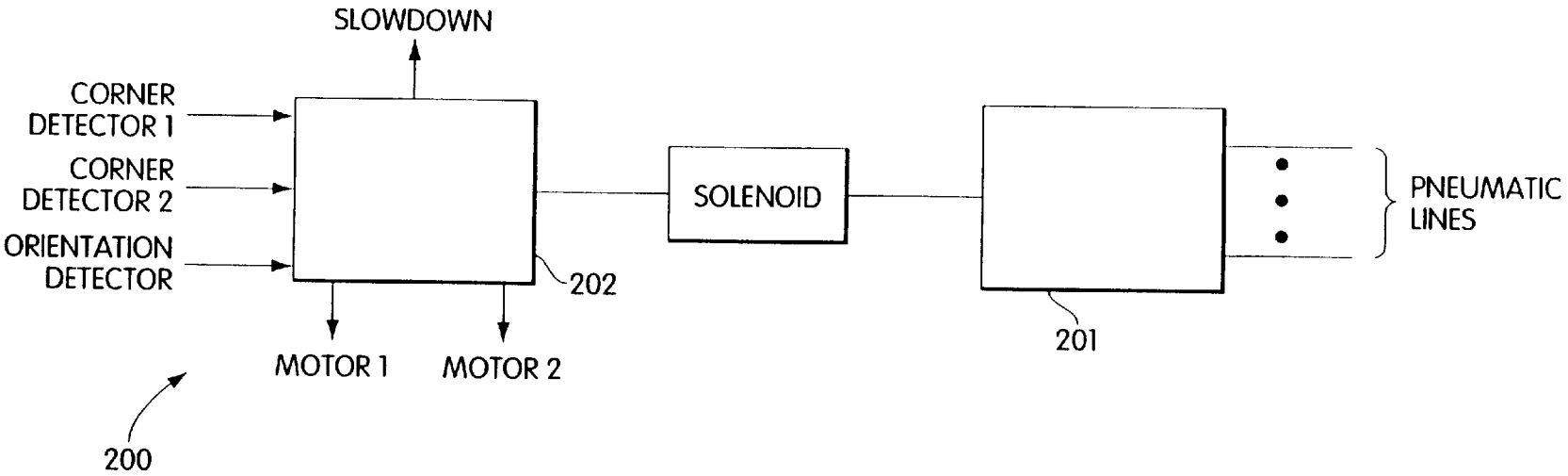
FIG. 8 is a block diagram showing operation of the controller.
Figure 9:
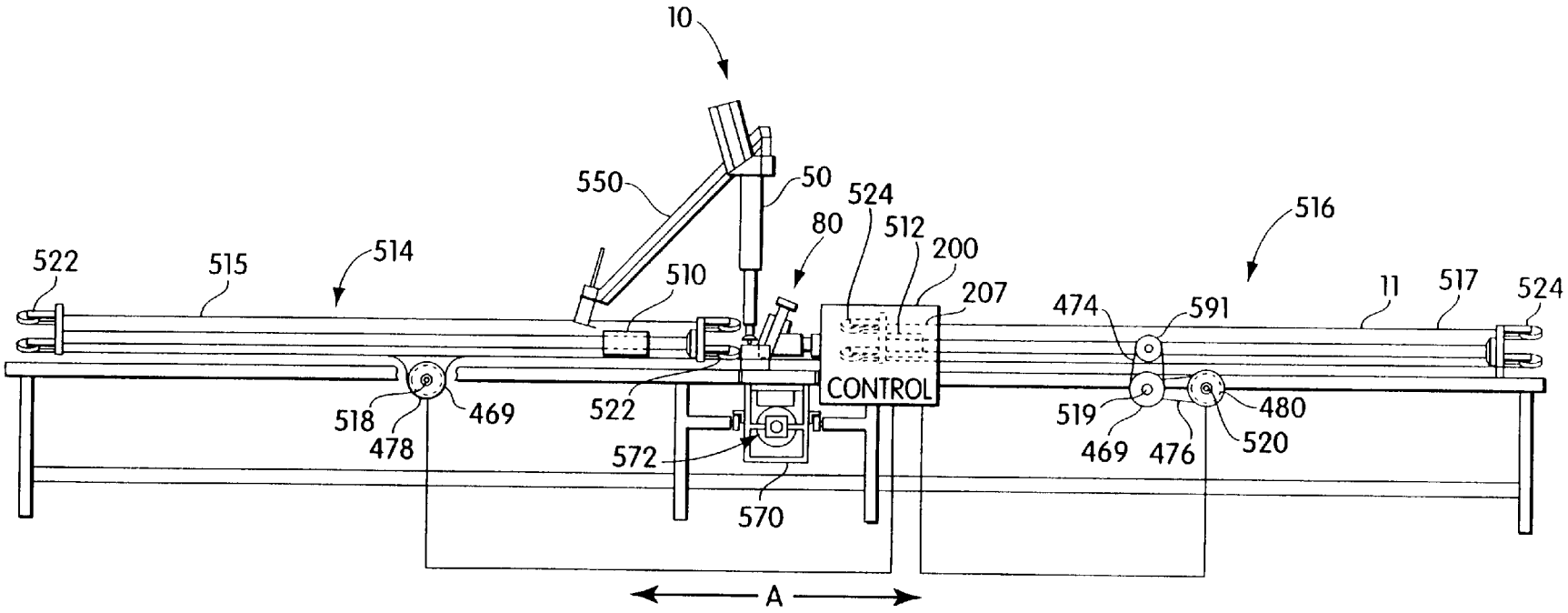
FIG. 9 is a schematic, elevation view illustrating another embodiment of the sewing apparatus of the present invention.

One embodiment of the rotating mechanism and method of this invention, including machine 10 and associated controller 200, will now be described with particular reference to FIGS. 1, 1A, and 8. Machine 10 includes stitcher 80, corner detectors 40*a* and 40*b*, pivot arm 50, mover arm 20, rotatable member 35, shoe 60, detector array 70, and correction wheel 30 in relation to a work surface 11 and a frame 5. Controller 200 provides electronic control signals and pneumatic pressure to various air lines for the components described below. The construction of the pneumatic logic 201 and electronic logic 202 will be apparent upon reading the description herein The table has a work surface 11. In a preferred embodiment the table is an air table.

Figure 1:
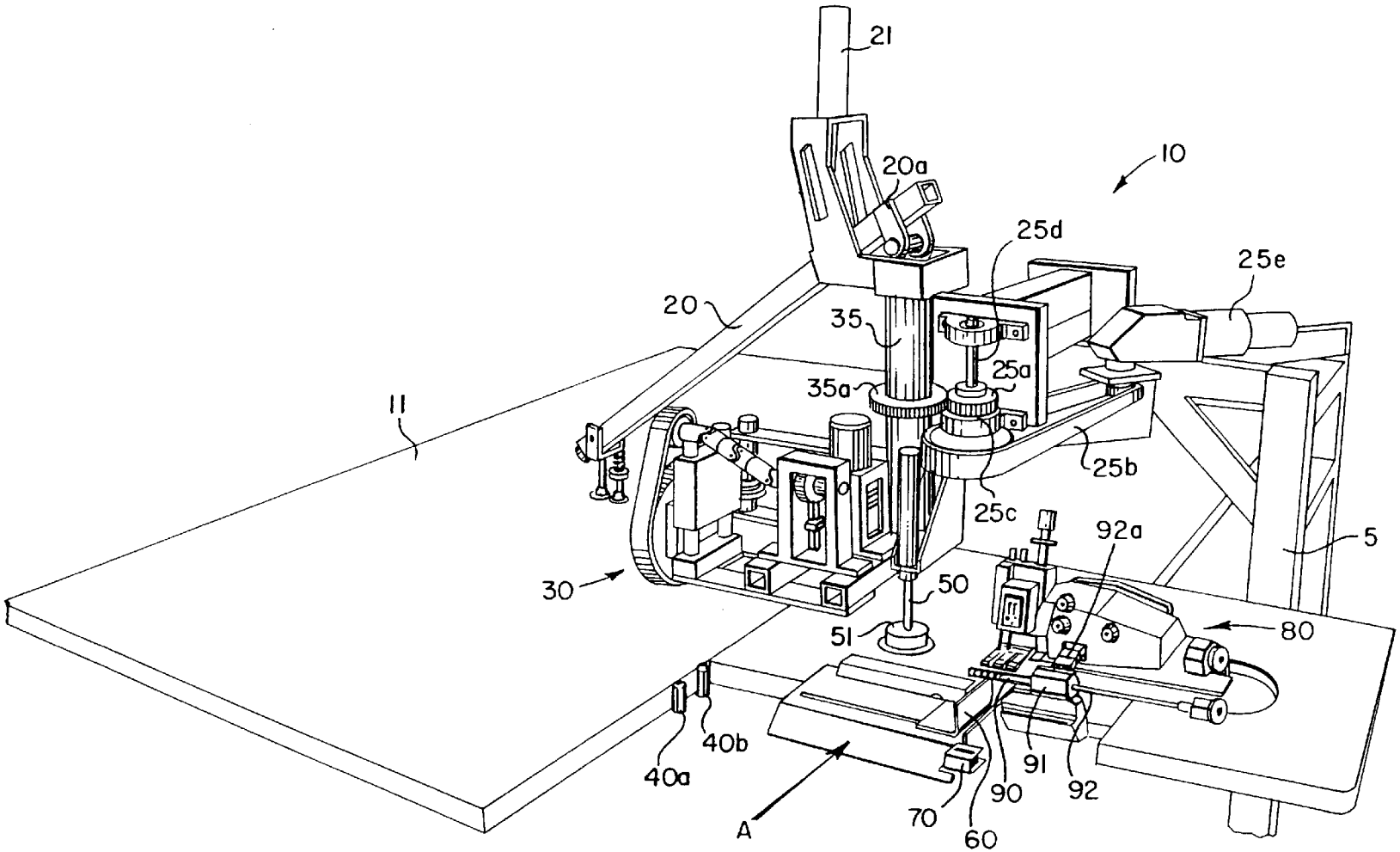
FIG. 1 is a first perspective view of the apparatus of this invention.
Figure 1A:
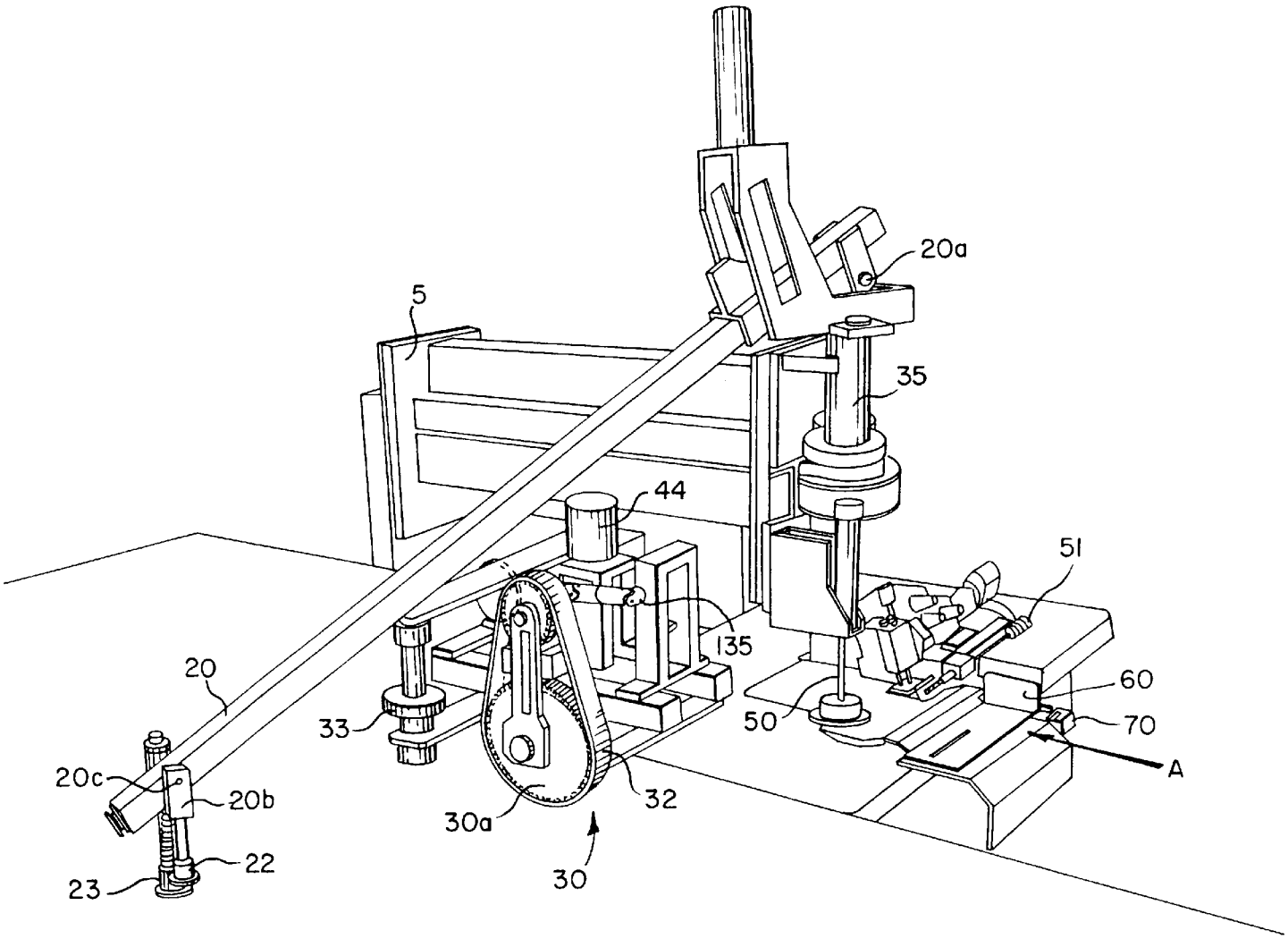
FIG. 1A is a second perspective view of the invention.

Referring to FIG. 1, the invention operates in conjunction with a conventional stitcher 80, which has certain modifications described below. An example is a machine such as the Porter 1000 or Porter 518 (which implements an overcast stitch), sold by Porter Sewing Machine, Inc., of Beverly, Mass. Other stitchers may be used to join the materials with border tape or with a gusset, for example. In a preferred embodiment, stitcher 80 includes a controller and encoder, so that stitches may be counted. Stitch counting may then used to determine when the top panel is completely joined. However, in another embodiment, instead of counting stitches, the controller can be indexed each time the panel is rotated to count the number of rotations. Because stitchers are known in the art, they will not be further discussed. In a preferred embodiment, stitcher 80 receives an electronic signal from controller 200, instructing the stitcher to slow the stitching speed, as discussed below.

Stitcher 80 ordinarily receives the materials along a true direction indicated as "A". The materials are joined along respective edges, with known techniques. A corner detector 40*a* is positioned at a fixed distance relative to the needle to detect the presence of a corner of the top panel. In a preferred embodiment, detector 40*a* is an ultrasound proximity detector and is fixed to a side of the work surface 11 five inches longitudinally from the needle. Other detectors may be substituted, such as an infrared, photoelectric diffused sensor, such as that manufactured by Telemechanique. The infrared sensor utilizes a single head containing an infrared emitter and receiver. The detector 40*a* provides a first indicative signal to the controller, upon detecting the corner.

Upon receiving the first indicative signal, the controller instructs the stitcher 80 to slow its stitching speed. This is done so that the stitcher will both stitch and pull the panel more slowly, while it is rotated, as described below and so that the panel will not overshoot the location at which it is intended to pivot.

A second detector 40*b* is fixed in a similar manner, preferably spaced at a point 3 or 4 inches longitudinally from the needle. This detector provides a second indicative signal to the controller at that point. This point is referred to as the tangent point of the panel and represents the start of the rounded corner or the point where lines tangent to the corner transition from being parallel to the edge of the panel to being non-parallel to the panel edge. Upon receiving the second signal, the controller causes a pivot arm 50 to lower into engagement with the top panel at a corner 300 (see FIG. 3A) defined by the edge 301 that is being joined and the edge 302 the proximity of which was detected by corner detector 40*a* . Pivot arm 50 includes a rotatable disc 51, which has a bearing to allow free rotation of the disc. The disc 51 provides a rotation point for the top panel to rotate about. The arm 50 and disc 51 are a fixed distance in transverse alignment with the needle, relative to direction A, so that the rotation point allows stitching to continue, while the panel is rotated.

Controller 200 causes a mover arm 20 to engage the top panel, in response to the second indicative signal. Mover arm 20 has a fulcrum 20*a* attached to a rotatable member 35. A cylinder mount 21*a* is attached to member 35 and is disposed on a distal side of fulcrum 20*a*. Mount 21*a* holds a pneumatic cylinder 21. Cylinder 21 is attached to mover arm 20, and thus, mover arm 20 is raised and lowered about fulcrum 20*a*, in response to the controller.

Figure 5:
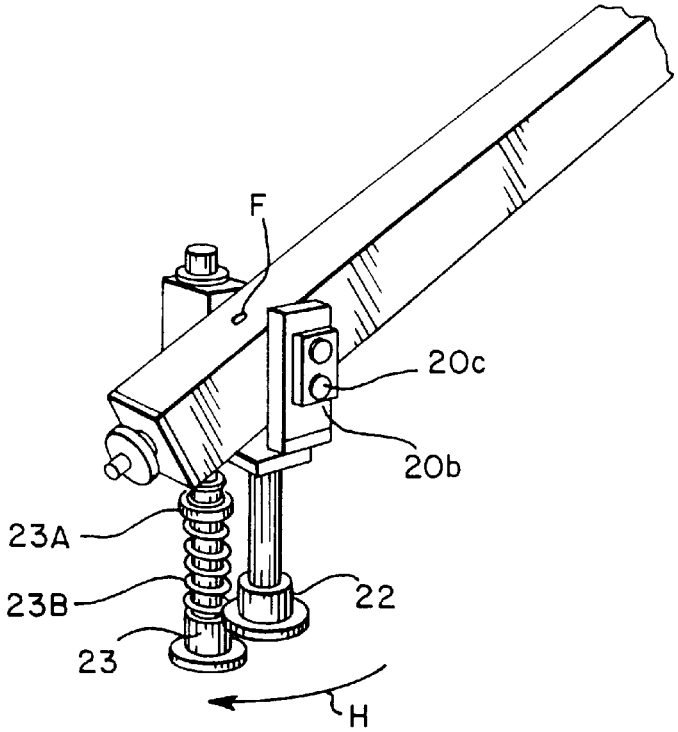
FIGS. 5A–5B illustrates a solid foot and spring foot engaging a panel.
FIG. 5C illustrates an alternative embodiment of the distal end of the mover arm.
FIG. 5D is a partial cut-away view of a distal end of a mover arm of the apparatus of FIG. 1.
FIG. 5E illustrates panel bunching.
Figure 5A:
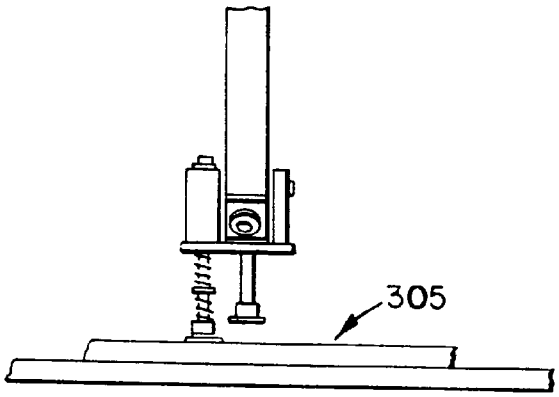
Figure 5B:
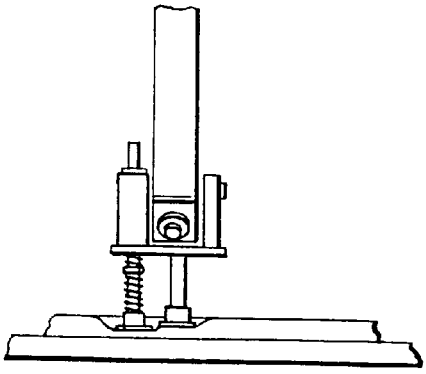

At the distal end of mover arm 20 are a solid foot 22 and a spring foot 23. These are shown in an enlarged view in FIG. 5. Spring foot 23 includes a compression spring 23B and a collar 23A which limits the amount of compression of spring 23B. Consequently, when mover arm 20 is lowered into engagement with the top panel 305, the spring foot first makes contact and compresses, and then, the solid foot makes contact, see FIGS. 5A and 5B. The two contact points provide a firm grip for rotating the panel.

Solid foot 22 and spring foot 23 are connected to yoke 206, which is attached to arm 20 by pivot shaft 20*c*. The pivot 20*c* allows yoke 20*b* to swing outward, as indicated by arrow H, when spring foot 23 makes contact with the top panel. This prevents the panel from rippling as shown by FIG. 5E, which may result from the downward and inward movement of arm 20, if the feet were rigidly fixed. Referring to partial cut-away view 5D, return spring 20*d* raises the yoke 20*b*.

The rotation of the mover arm 20 will now be described with reference to FIG. 1.

Frame 5 supports holds a gear drive 25*a* mounted with bearing 25*c* and attached to shaft 25*d*. Shaft 25*d* is rotated by belt 25*b*, in response to electric stepper motor 25*e*. Motor 25*e*, in turn, operates responsively to the controller. A gear 35*a* is fixed to rotatable member 35 and engages the gear drive 25*a*. As such, rotatable member 35 is caused to rotate under the control of the controller. When member 35 rotates, the mover arm 20 also rotates.

Figure 3A:
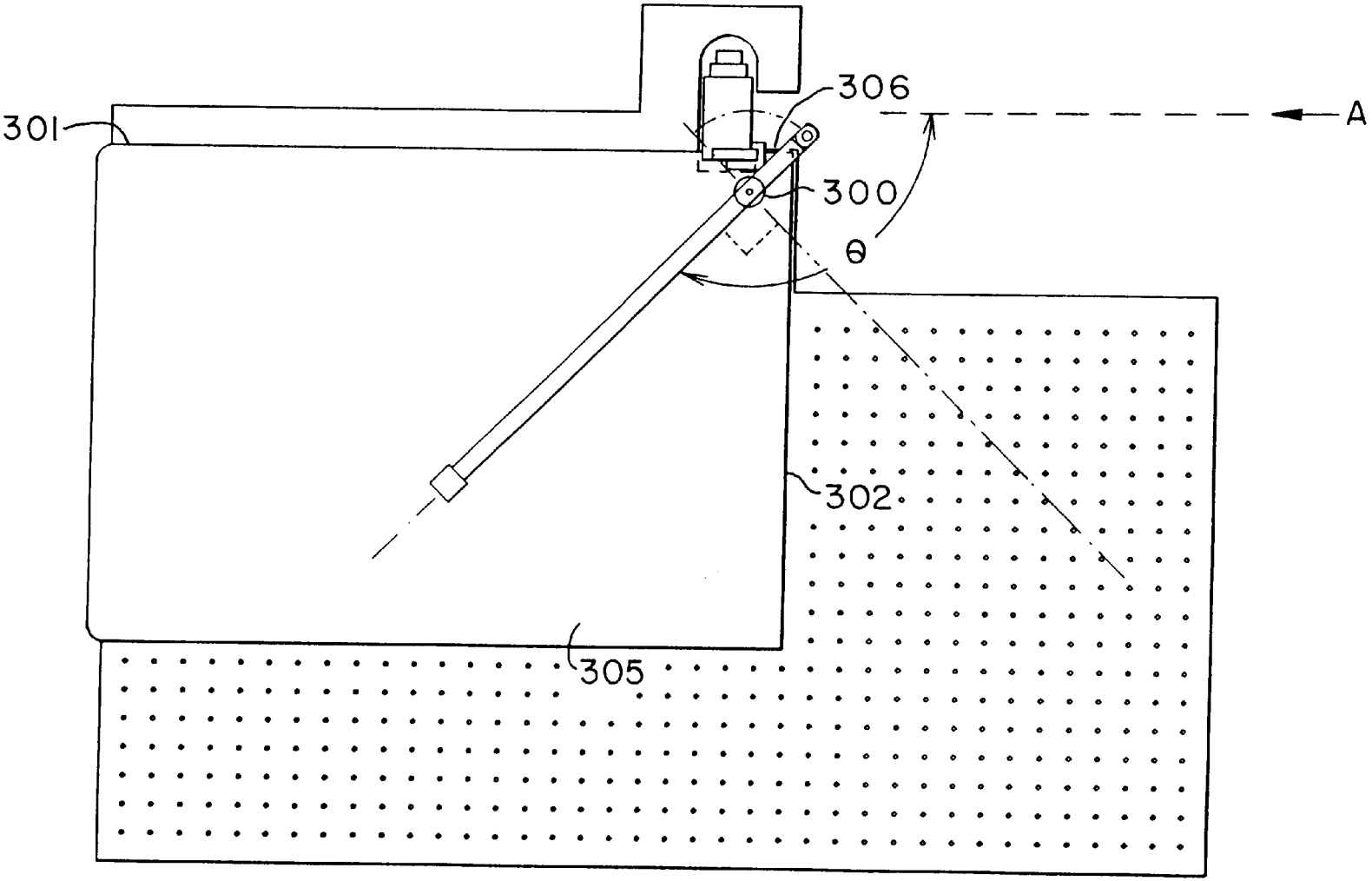
FIGS. 3A–3C illustrate the turning operation of the method of this invention.
Figure 3B:
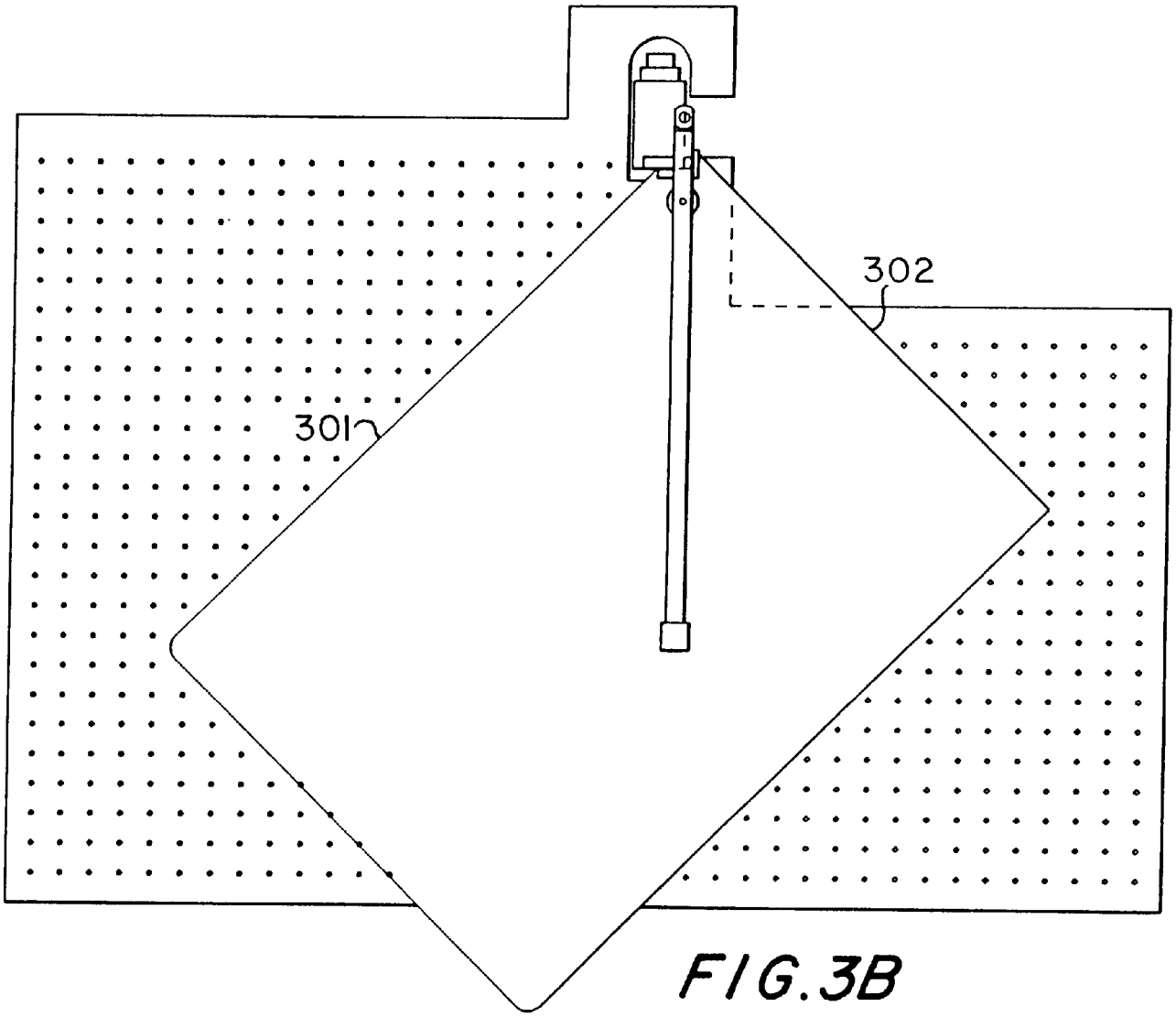
Figure 3C:
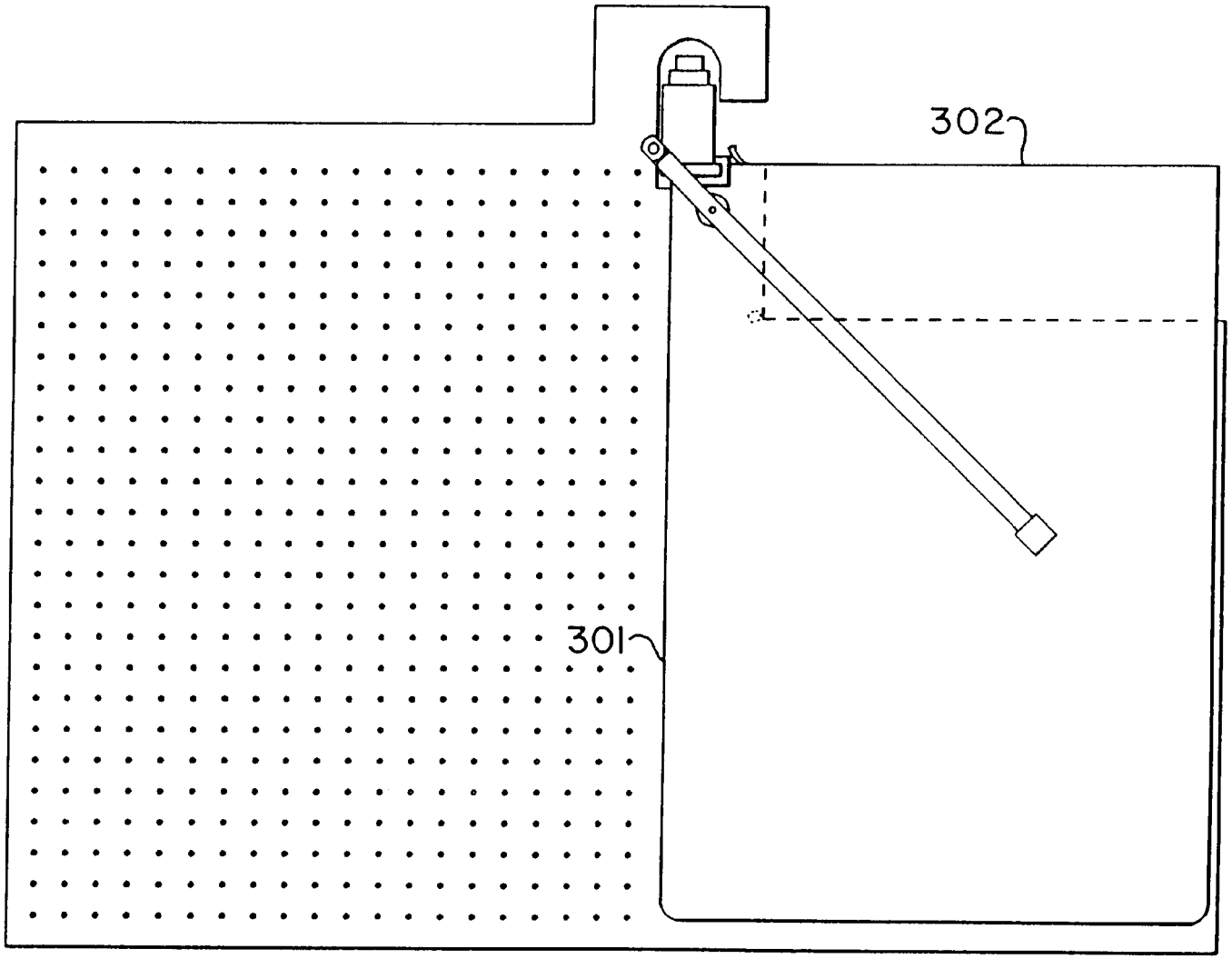

Referring to FIGS. 3A–3C, which are much-simplified, mover arm 20 preferably is disposed at an initial obtuse angle Θ relative to true direction A in its home position. FIGS. 3B and 3C respectively show the intermediate and final positions of panel 305, as it is pivoted through 90°. As can be seen, because of the positioning of arm 20 in its range of angles Θ to Θ-90°, arm 20 does not crowd or interfere with an operator in the proximity of stitcher 80.

The method of manipulating the panel will be described with reference to FIGS. 1–3. Materials are joined along an edge 301. When a corner 306 is detected, pivot arm 50 and mover arm 20 engage the panel 305 from the top and cause it to rotate. During the turning operation, the stitcher 80 operates at a reduced speed to stitch along the corners 306 of the panel. After which, a subsequent edge 302 is ready to be joined, the entire process being automated. Stitches are counted to determine the completion of the application, or the number of rotations of the panel is counted.

Figure 5C:
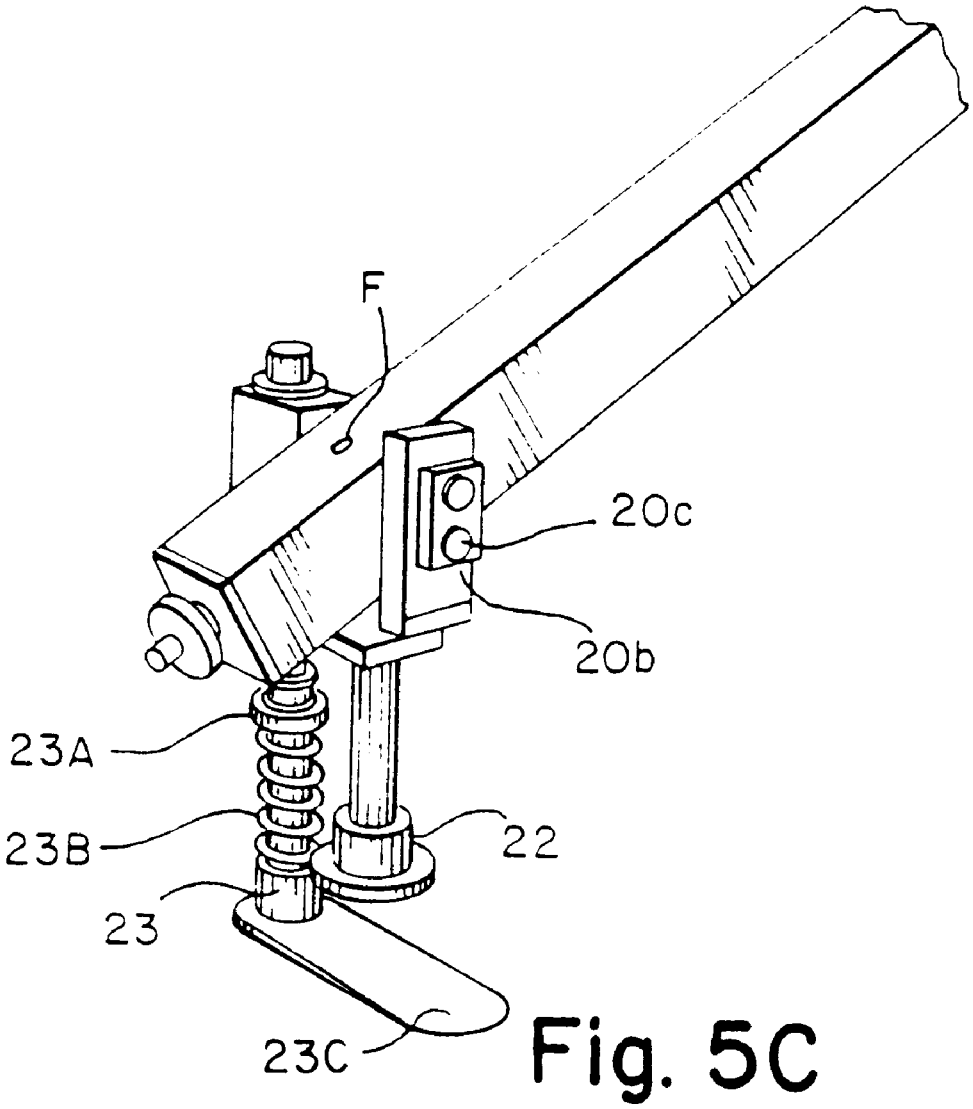
Figure 5D:
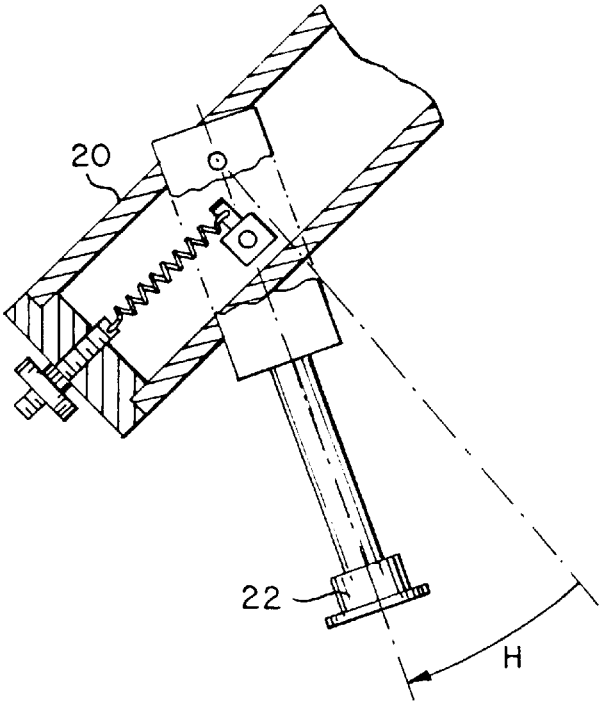
Figure 5E:
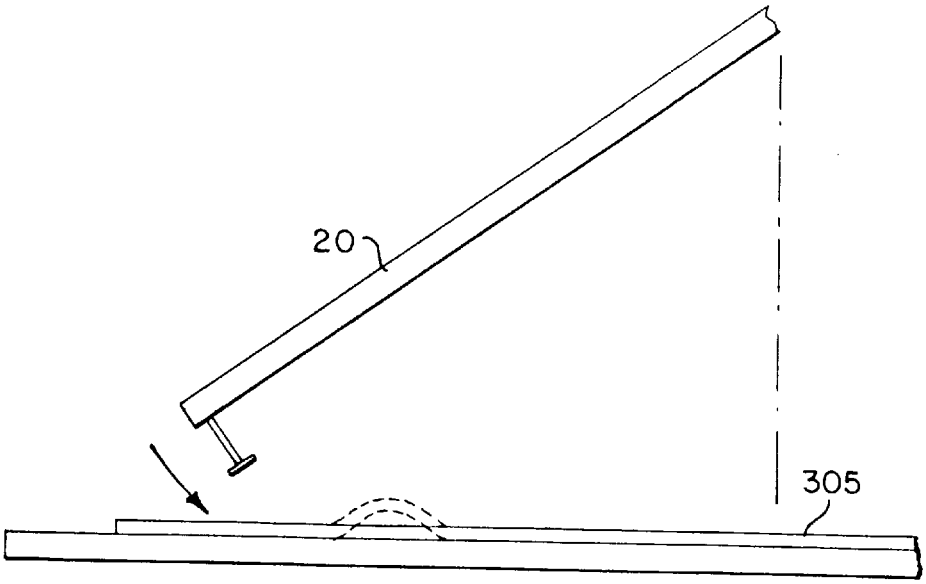

Alternatively, referring to FIG. 5C the spring foot 23 may be replaced by a shovel-foot having a shovel element 23C. Arm 20 would be positioned so that the shovel foot contacted the work surface 11. Arm 20 rotates so that the shovel 23C slides under the fabric, and the arm is subsequently lowered further so that the solid foot 22 engages the panel from above, while the shovel 23C engages from below. The arm would be initially positioned parallel to edge 301 of FIG. 3A. This type of grip is preferable for less stiff panels, such as bedspreads.

Figure 7:
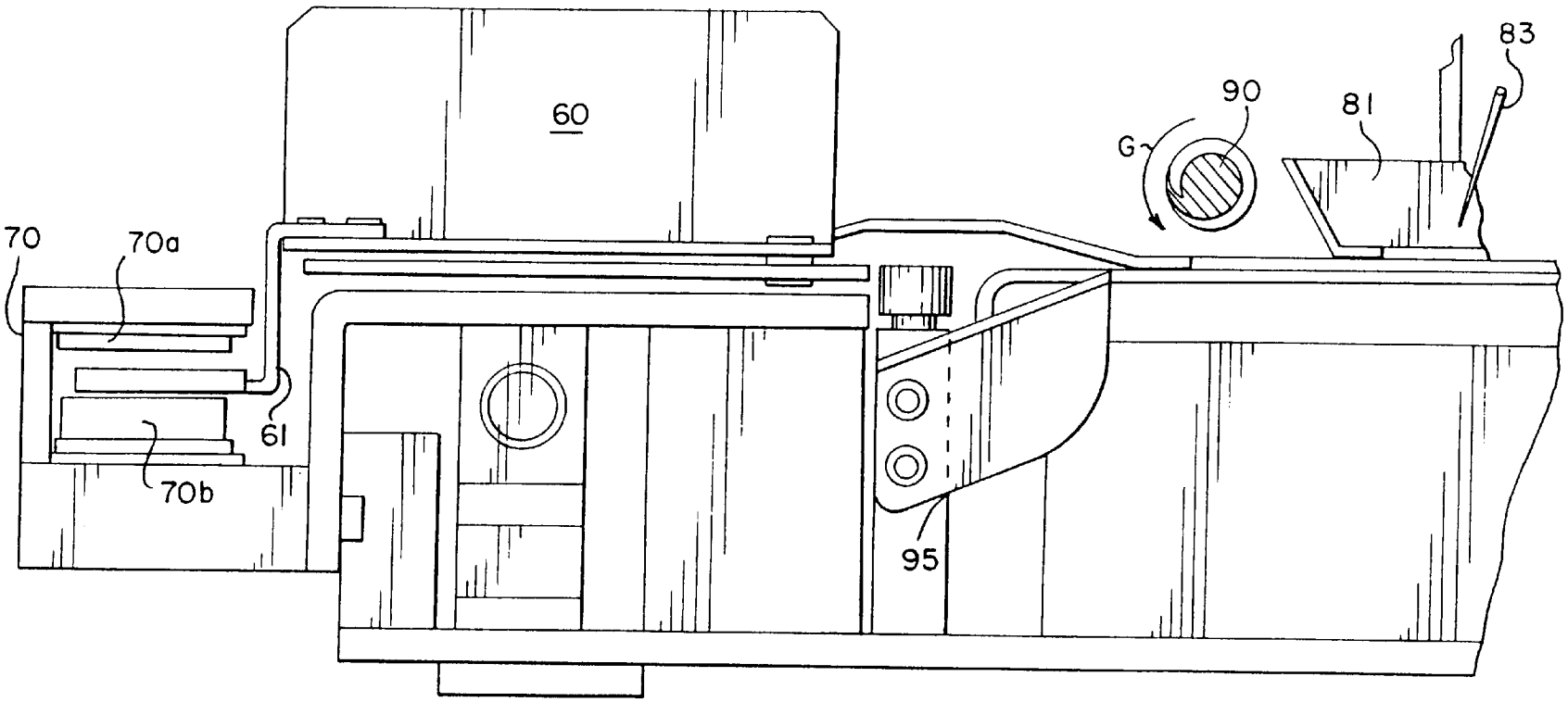
FIG. 7 is an enlarged side elevational view of the panel cutter in relation to the shoe, panel flattener and flange cutter.

In a preferred embodiment, the invention also includes a flange cutter 95. Referring to FIG. 7, pneumatic flange cutter 95 cuts the flange material at the end of the application, that is, after all edges are sewn. The cut is transverse to the longitudinal direction A. Consequently, the flange has a cleaner cut than that achievable when it is cut by hand.

Figure 6:
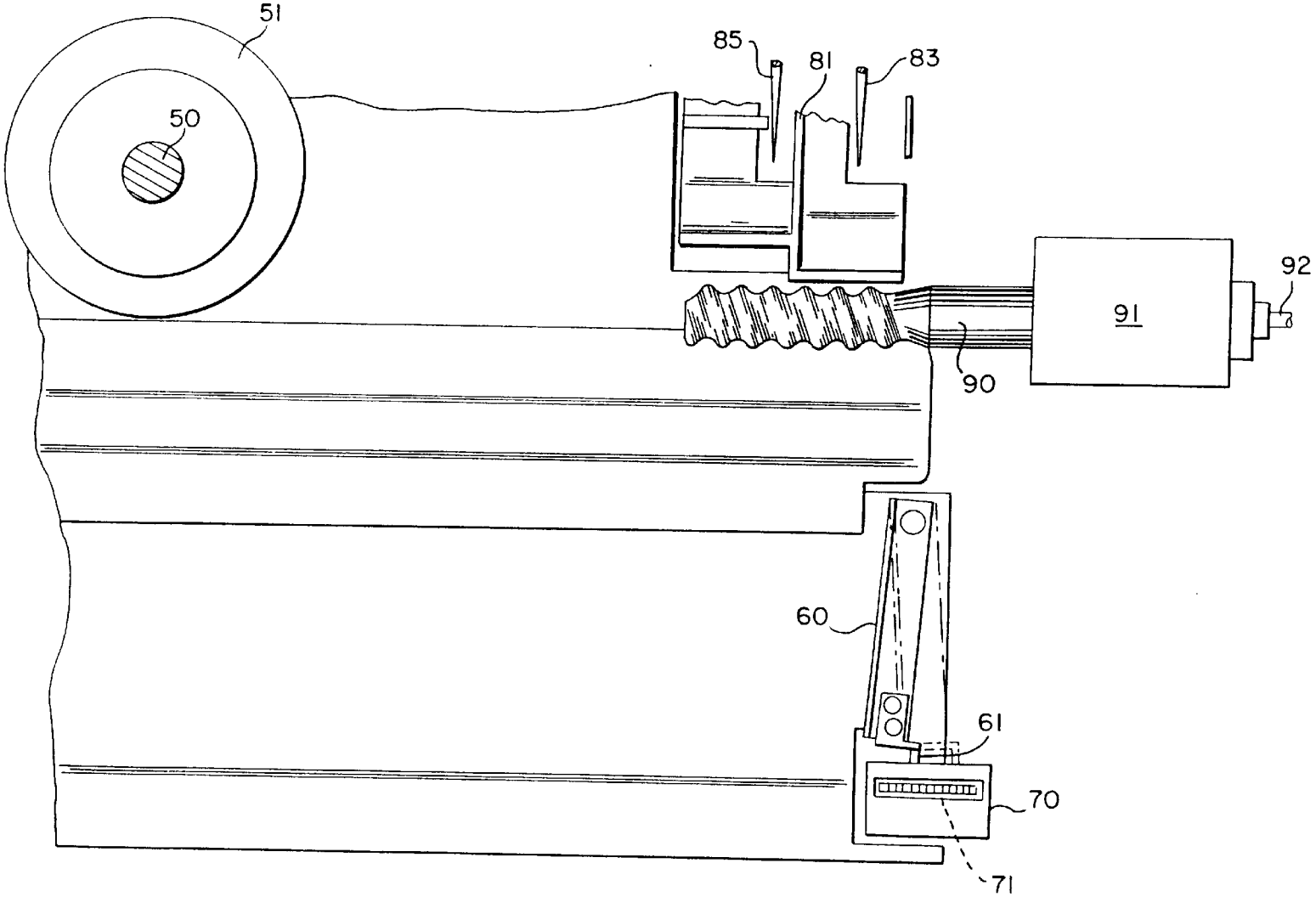
FIG. 6 is a top plan view which illustrates the panel flattener in relation to the shoe and panel cutter.

Referring to FIGS. 6 and 7 conjointly, a preferred embodiment of stitcher 80 includes a Wilcox-Gibbs type cutter 81 to cut material longitudinally, as the material is stitched, to provide high quality sizing. Panel cutter 81 moves up and down in synchronism with needles 83 and 85 of stitcher 80. As such, cutter 81 provides the ability to round the corners (307, FIG. 3A) of top panel 305, as they are rotated, and cuts an edge (301, see FIG. 3A) of the panel a fixed distance from the stitch. The cutter operates synchronously with the needle as is known in the art. Needle 83 typically produces an overedge stitch while needle 85 typically produces a chain stitch.

Figure 21:
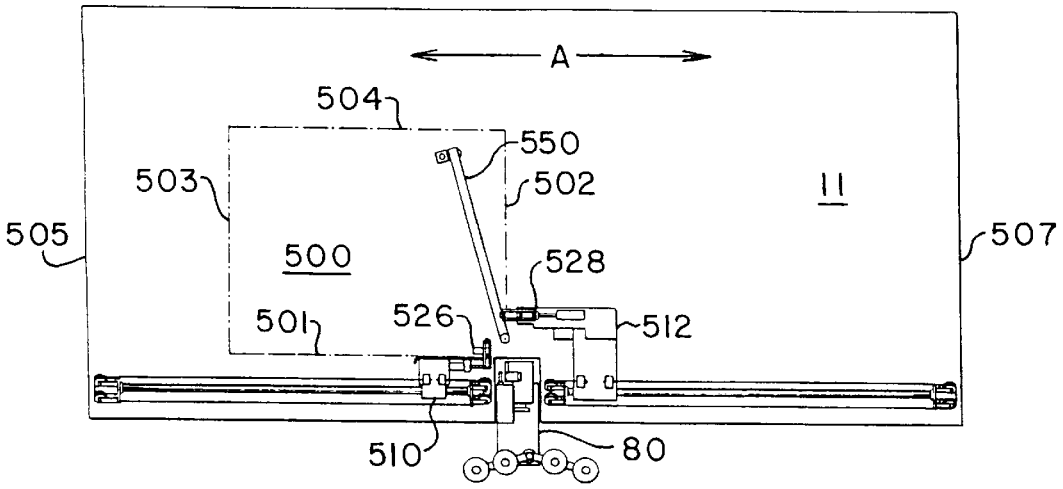
FIG. 21 is a top, schematic plan view of the apparatus of FIG. 9 showing the panel and apparatus in one operating position.

Another embodiment of the rotating and fabric manipulating apparatus and method of this invention will now be described with particular reference to FIGS. 9–26. Like numbers will be used for like parts, where applicable. This embodiment includes machine 10 with stitcher 80 having needles 83 and 85 and cutter 81, pivot arm 50, associated controller 200, control panel 207 and work surface 11, which as indicated preferably is an air table. This embodiment will be described in conjunction with a fabric panel 500, such as a top panel of a mattress cover, having edges 501, 502, 503 and 504 (FIG. 21).

In this embodiment, manipulation of a panel 500 of flexible fabric is assisted by apparatus which includes two sleds, a first sled 510 and a second sled 512, mover arm 550 and dolly 570. Sleds 510 and 512 travel in the true direction A along surface 11. Sleds 510 and 512 may be driven in any conventional manner by respective drive systems 514 and 516. Typically, systems 514 and 516 are cable drives which are operated independently by respective servo motors 518 and 520. System 514 includes a cable 515 which is attached at one end to one side of sled 510 and at the other end to the other side of sled 510. Cable 515 passes over pulleys 522 disposed at each end of its travel path. Similarly, cable 517 passes over pulleys 524 disposed at each end of its travel path, and is attached at each end to opposite sides of sled 512. Typically, cables 515 and 517 respectively are wrapped about pulleys 469 on associated servo motors 518 and 520.

Figure 13:
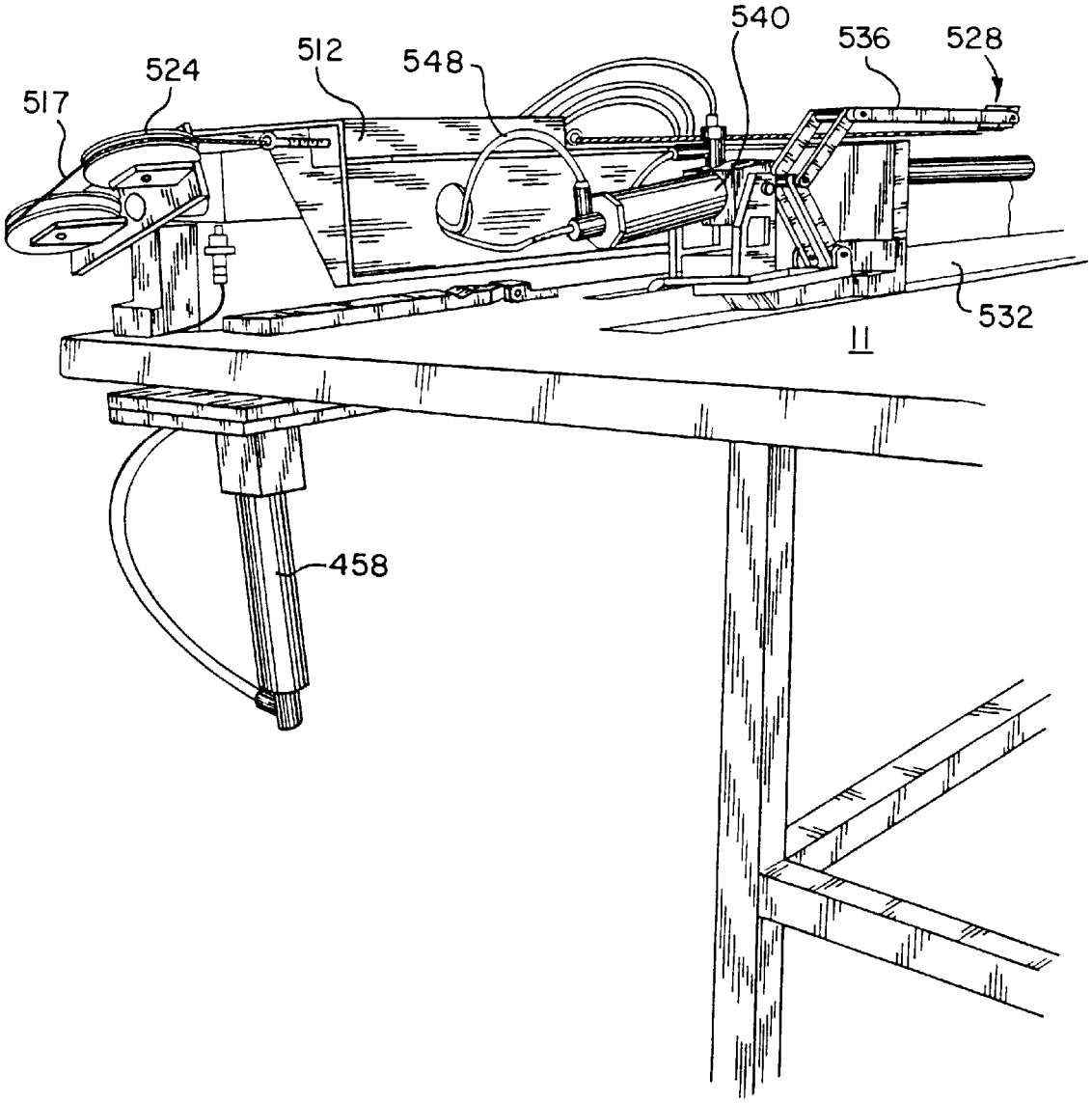
FIG. 13 is a partial, perspective view of one portion of the apparatus of FIG. 9.

Each sled 510 and 512 includes a respective pneumatically actuated clamp 526 (FIG. 16) and 528 (FIG. 13). Each clamp 526 and 528 includes a respective lower plate 530 and 532 and a respective upper, pivotally mounted clamp arm 534 and 536. Each arm 534 and 536 is operated by an associated pneumatic cylinder 538 and 540. Plates 530 and 532 travel or slide along surface 11 and are sufficiently thin that they each will slide between a panel 500 and surface 11 without producing any movement of panel 500. Disposed on plate 530 is a proximity sensor 542 which is adapted to detect an edge of panel 500. Sensor 542 detects an edge of panel 500 as sled 510 moves towards that edge. If sensor 542 is covered by panel 500, clamp arm 534 remains in a raised position. When sensor 542 passes an edge of panel 500 and is no longer covered by panel 500, controller 200 actuates cylinder 538 to produce a clamping motion of arm 534 downwardly against plate 530 to clamp an edge of panel 500 to sled 510. Typically, sensor 542 is an infrared photoelectric diffused sensor such as that manufactured by Telemechanique, An ultrasonic position or proximity sensor could also be used. Cylinder 540 is actuated to pivot arm 536 downwardly to clamp an edge of panel 500 in response to signals received from controller 200. As can be seen, clamp 526 typically is oriented on sled 510 so as to clamp an edge 501 adjacent on edge 503 of panel 500, edge 501 being generally parallel to the true direction. Clamp 528 is oriented on sled 512 so as to clamp an edge 502 which is oriented in a direction generally perpendicular to the true direction A.

System 514 extends from adjacent edge 505 of surface 11 to a point closely adjacent stitcher 80 to permit sled 510 to travel from edge 505 in the true direction A to its home position adjacent stitcher 80. Similarly, system 516 extends from adjacent edge 507 of surface 11 to a point closely adjacent stitcher 80 to permit sled 512 to travel from edge 507 to its home position closely adjacent stitcher 80.

Pneumatic lines 548 couple both cylinders 538 and 540 to a source of compressed air and extend-along systems 514 and 516. Preferably, a known mechanism 549 is provided for gathering pneumatic lines 548 and for providing a flexible casing for allowing lines 548 to pay out with movement of sleds 510 and 512 and for preventing lines 548 from becoming entangled in systems 514 and 516 or sleds 510 and 512. A typical mechanism 549 is an articulated, semi-rigid chain through which lines 548 pass. Such a chain is sold by Igus Co. of Rhode Island under the trademark NYLATRAK.

Figure 10:
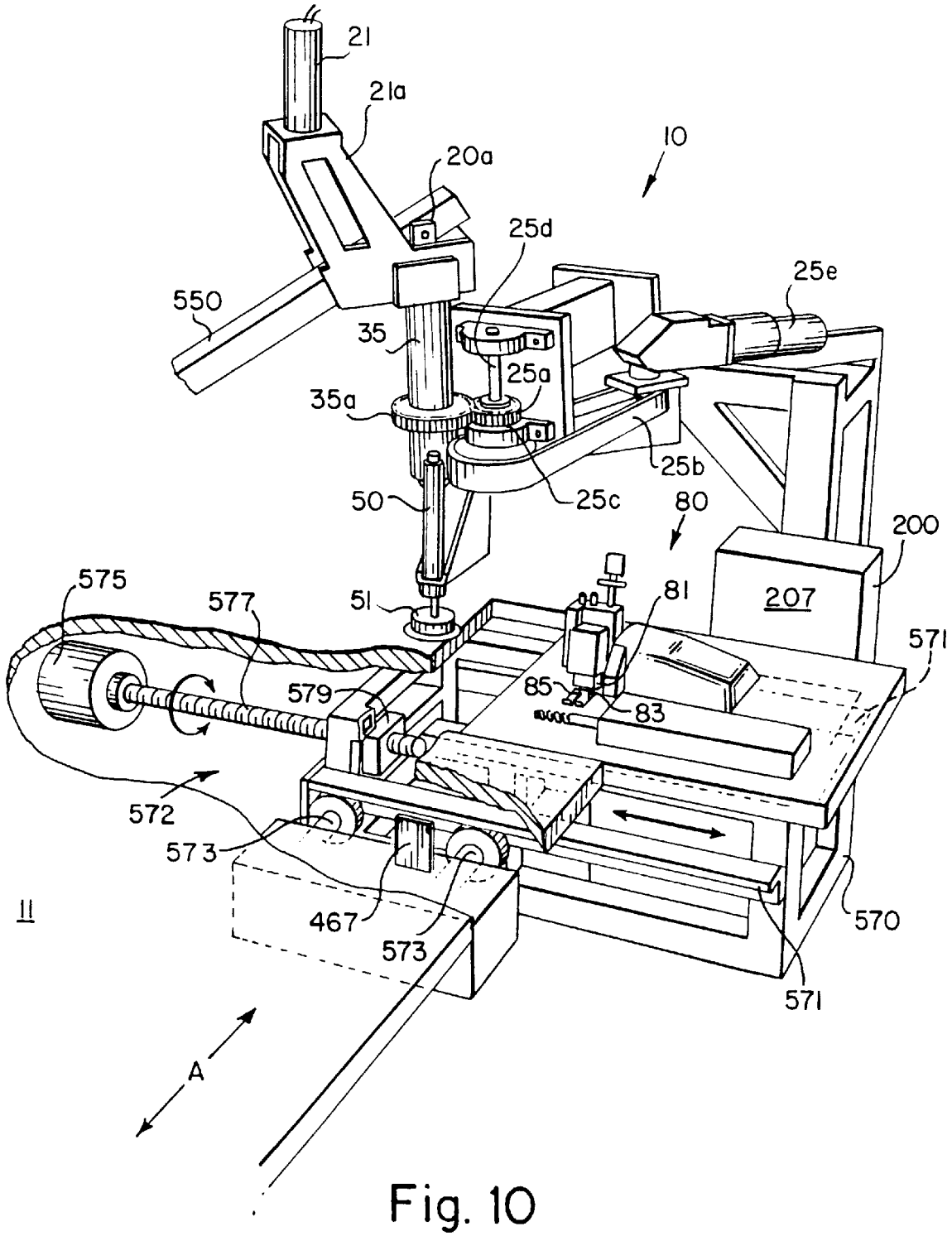
FIG. 10 is a partial, partially cutaway perspective view of the sewing apparatus of FIG. 9.
Figure 11:
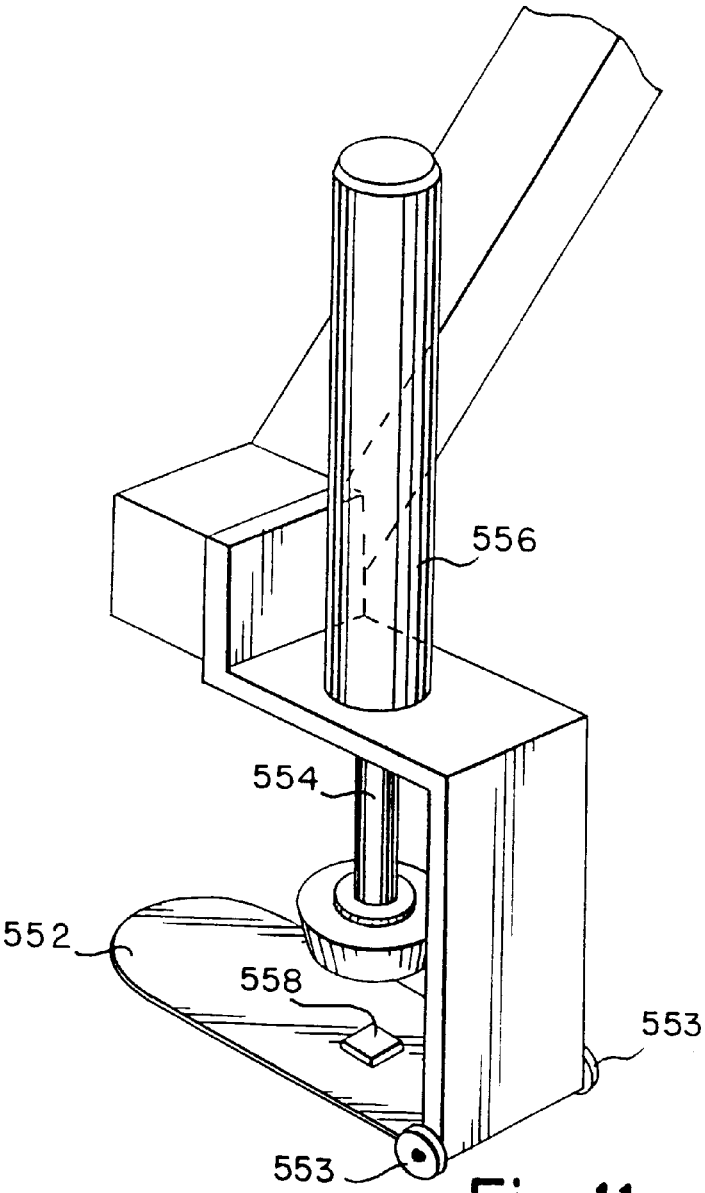
FIG. 11 is a partial perspective view of the distal end of the mover arm of the apparatus of FIGS. 9 and 10.
Figure 12:
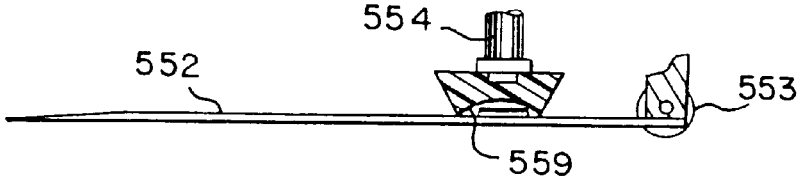
FIG. 12 is a cross-sectional side view of a portion of the distal end of the arm of FIG. 11.

Pivot arm 50 is identical to the pivot arm of the previous embodiment and includes rotatable disk 51, as shown in FIG. 10. Mover arm 550, like mover arm 20, includes pneumatic cylinder 21, fulcrum 20*a*, rotatable member 35, cylinder mount 21*a*, gear drive 25*a*, bearing 25*c*, shaft 25*d*, belt 25*b*, servo motor 25*e*, and gear 35*a* (FIG. 10). Mover arm 550 of this embodiment differs in structure from mover arm 20 of the previous embodiment at its distal end in that mover arm 550 actually grabs an edge of panel 500 and pulls panel 500 through its pivot about pivot arm 50. As shown in FIGS. 11 and 12, arm 550 includes a lower plate 552 and an upper plunger 554 which is actuated by a pneumatic cylinder 556. Lower plate 552 is disposed parallel to surface 11 and is sufficiently thin that plate 552 can pass between panel 500 and surface 11 without disturbing panel 500 or causing movement thereof. Preferably, plate 552 rides on wheels 553. Disposed on the top surface of plate 552 is a proximity sensor 558. Sensor 558 preferably is an infrared photoelectric diffused sensor such as that manufactured by Telemechanique. However, an ultrasonic proximity sensor also could be used. Sensor 558 detects an edge of panel 500, such as edge 503 causing actuation of cylinder 556, which drives plunger 554 downwardly to clamp edge 503 between plunger 554 and plate 552. Plunger 554 normally is raised except when actuated by controller 200 in response to sensor 558. Plunger 554 includes a concave recession 559 at its tip whose edges surround sensor 558 to prevent damage to sensor 558 as plunger 554 drops.

Two proximity sensors 560 and 562 (FIG. 16) are disposed on a side of stitcher 80 facing sled 510. These sensors or detectors 560 and 562 correspond to detectors 40*a* and 40*b* of the previous embodiment, and detect the location of sled 510. Preferably sensors 560 and 562 are disposed on a vertical guide or support wall 561 for system 514. Sensor 560 is positioned to signal when edge 503 is 5 or 6 inches from the needle 83. Sensor 560 causes stitcher 80 to slow from its normal operating speed, such as 3200 RPM's, to a jogging speed of about 400 RPM's. Sensor 562 is positioned to signal when edge 503 is at the tangent point, which is about four inches from needle 83. At this point, the stitching operation is stopped. This use of two sensors allows the stitching operation to stop within one or two stitches of the desired location, and prevents overshoot. Normally the stitcher 80 would require many stitches to stop. Overshoot of the tangent point would produce a non-symmetrical corner. Sensors 560 and 562 also are typically infrared photoelectric diffused sensors such as that manufactured by Telemechanique, but could also be ultrasonic sensors.

In this embodiment, as shown in FIG. 10, stitcher 80 typically is disposed on a moveable dolly 570 which rides on rails 571 which are oriented in a direction perpendicular to the true direction A. Rails 571 rest on rollers 573. Dolly 570 is moved along rails 571 in a direction perpendicular to the true direction A by a drive such as a conventional screw drive 572 which is operated by servo motor 575 and controlled by controller 200. Drive 572 includes threaded screw shaft 577 which rotates and extends through mating, stationary threaded block 579 which is affixed to dolly 570. Typically, dolly 570 has a range of travel of about 6 inches on rails 571. Servo motor 575 serves to lock dolly 570 into a desired position. The location of dolly 570 is monitored by sensor 467.

System 516 preferably includes a slip clutch mechanism 519 such as a pneumatic pressure clutch which allows sled 512 to apply tension to panel 500 along edge 502 without tearing panel 500 or without overriding the mechanism of stitcher 80 which pulls panel 500 through stitcher 80. Clutch 519 is coupled to servo motor 520 by a belt 476, and clutch 519 is connected to cable 517 through a pulley (not shown). As a result, sled 512 moves only as fast as stitcher 80 will allow.

Both servo motors 518 and 520 are provided with respective shaft encoders 478 and 480 to track the position of respective sleds 510 and 512 in a known manner. However, because of clutch mechanism 519, system 516 also requires a slave shaft encoder 591 coupled to the shaft of clutch 519, such as by a belt 474 to keep track of the location of sled 512. Belt 474 moves only when and as much as cable 517 and thus precisely tracks the location of sled 512.

The operation of this embodiment of the invention will now be described with particular reference to FIGS. 15–26. This sequence of events is exemplary only, and the sequence and timing of the events and the particular steps themselves could be varied as desired to produce automatic stitching and rotation of panel 500. To initiate the process, the operator pushes a reset button on control panel 207. In response, controller 200 returns sleds 510 and 512 to their home positions adjacent stitcher 80. (See FIGS. 15 and 21.) The home position for sled 510 typically is at the tangent point, which as previously discussed, preferably is about four inches from needles 83 and 85 of stitcher 80. However, this distance can be greater or lesser depending upon the needs of the particular process, and it can be readily adjusted by making the appropriate entries in control panel 207. The home position for sled 512 typically is that shown in FIGS. 15 and 21 in which sled 512 is closely adjacent stitcher 80, and in which clamp 528 is generally aligned with needles 83 and 85 of stitcher 80 in a direction generally perpendicular to the true direction A. In the home position, clamp arm 536 is in a raised position and thus clamp 528 is open.

Arm 550 is initially in a position such that plate 552 is raised above surface 11. This positioning is accomplished by actuating cylinder 21 and pivoting arm 550 about fulcrum 20*a*. Arm 550 then pivots in a counter clockwise direction, as shown in FIG. 21, until arm 550 is aligned generally parallel with the true direction A. Thereafter, arm 550 reverses its direction of movement to pivot in a generally clockwise direction, as shown in FIG. 21, until it reaches a position as shown in FIG. 21. In this orientation, arm 550 is aligned so that plate 552 does not interfere with any movement of the other portions of the apparatus, and so that arm 550 is disposed at approximately an angle of about 90° plus or minus 30° with respect to the true direction A.

At about the same time, screw drive 572 is activated to withdraw dolly 570 from surface 11 along rails 571 sufficiently that needles 83 and 85 of stitcher 80 are out of the way during placement of panel 500. Typically, dolly 570 is withdrawn about six inches. Thereafter, as shown in FIG. 21, the operator manually places a panel 500 to be sewn in the stitching area on surface 11 so that one edge of panel 500, such as edge 501, is beneath needles 83 and 85 of stitcher 80 and is disposed generally parallel to the true direction A. Edges 502 and 503 are disposed generally perpendicular to direction A. Preferably, panel 500 is positioned so that edge 502 is aligned with needles 83 and 85 of stitcher 80, and with clamp 528 of sled 512. It is important that panel 500 lie flat on surface 11 and not be wrinkled or otherwise bunched up. Since sled 510 is in its home position, sensor 542 on plate 530 of sled 510 is covered by panel 500.

Figure 16:
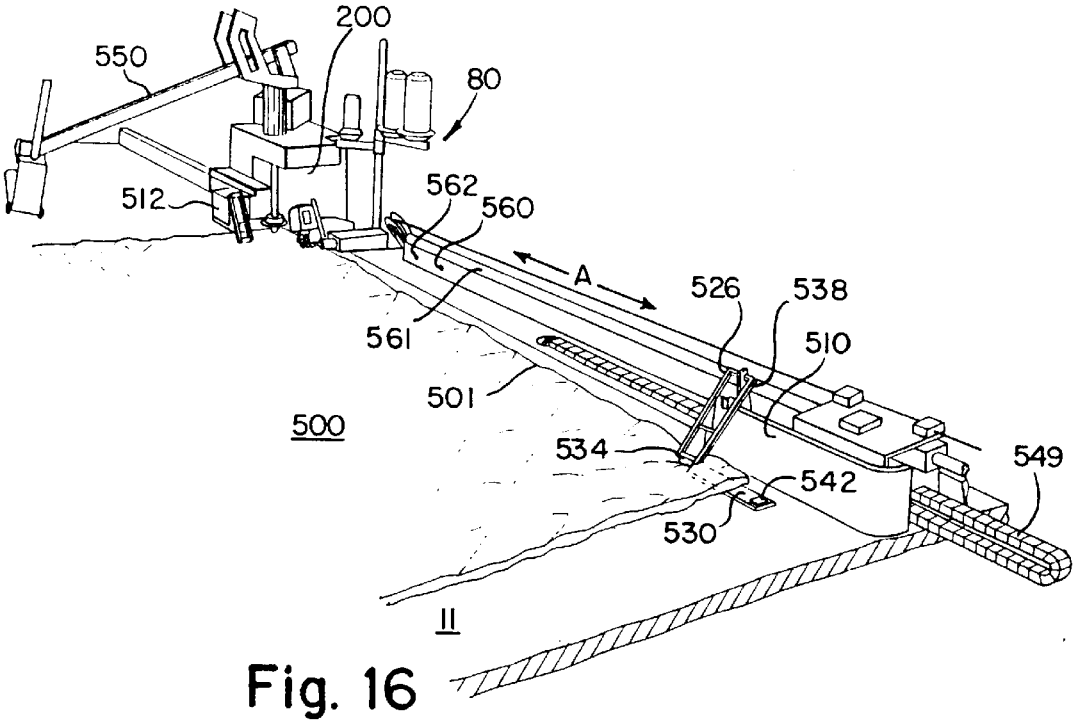
FIG. 16 is a partial, perspective view of the apparatus of FIG. 15 in another operating position.
Figure 22:
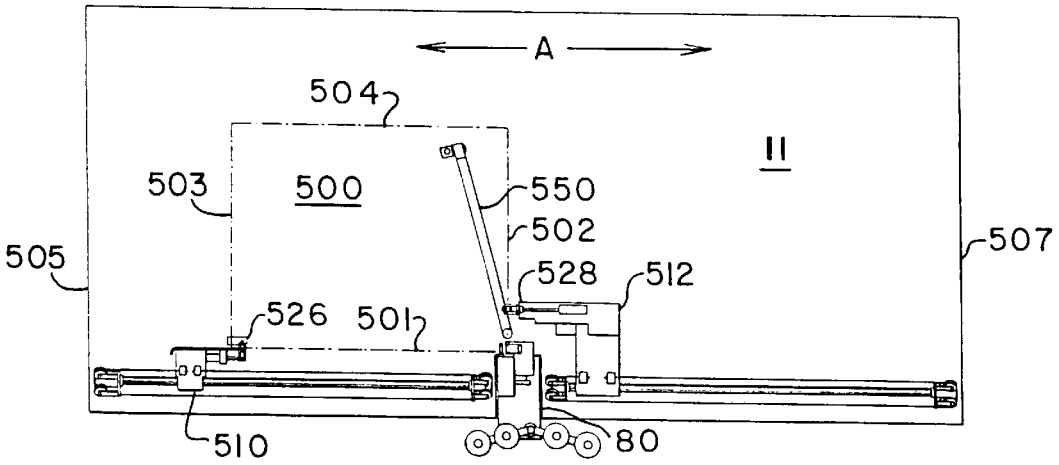
FIG. 22 is a top, schematic plan view of the apparatus of FIG. 9 showing the panel and the apparatus in another operating position.

The operator then pushes a "measure" button on control panel 207 to activate cylinder 540 to cause clamp 528 to grab edge 502, as shown in FIGS. 16 and 22. Thereafter, sled 510 begins moving from right to left as shown in FIG. 22 to search for edge 503 and to measure the length of edge 501. Once sensor 542 passes out from beneath panel 500 and beyond edge 503, clamp 526 is activated in the manner previously described, to grab edge 501 adjacent edge 503.

Figure 23:
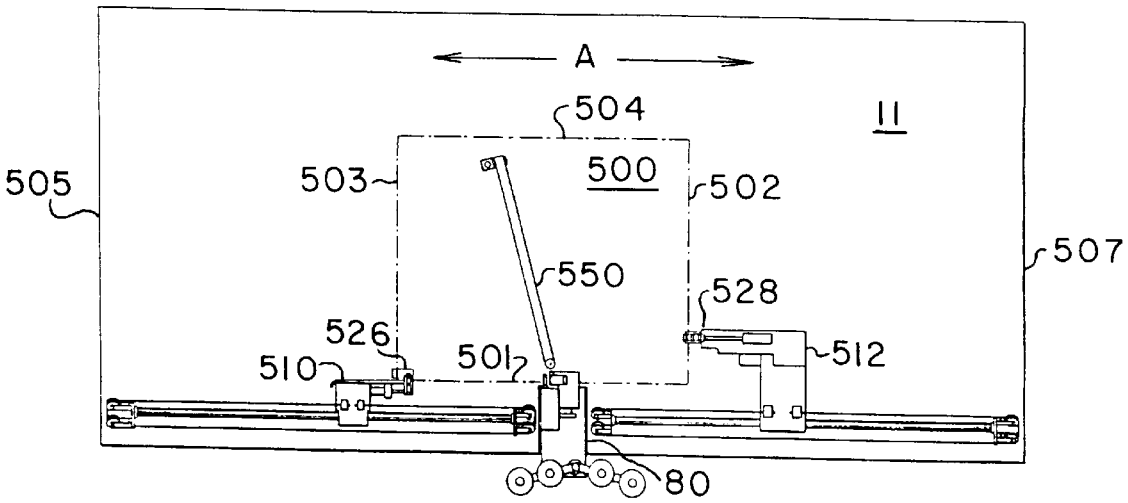
FIG. 23 is a top, schematic plan view of the apparatus of FIG. 9 showing the panel and the apparatus in yet another operating position.

Thereafter, controller 200 automatically moves panel 500 to the right as shown in FIG. 23, until needles 83 and 85 of stitcher 80 are located at a starting point, such as approximately twelve inches from the tangent point of edge 503, or approximately 16 inches from edge 503.

Figure 17:
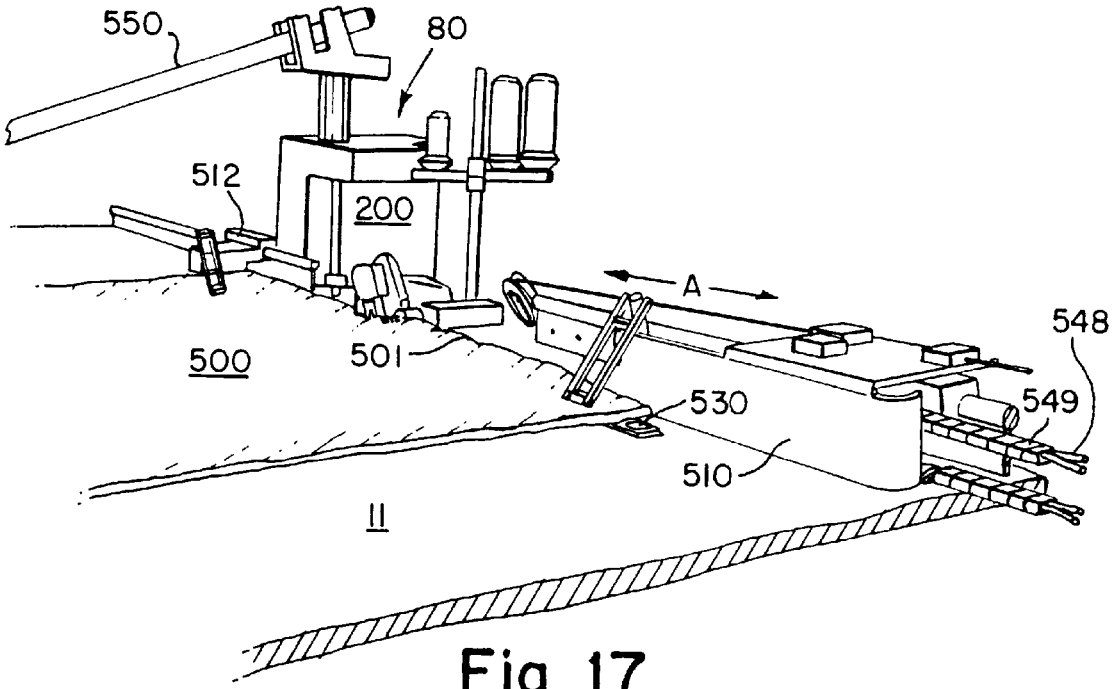
FIG. 17 is a partial, perspective view of the apparatus of FIG. 15 in a further operating position.
Figure 18:
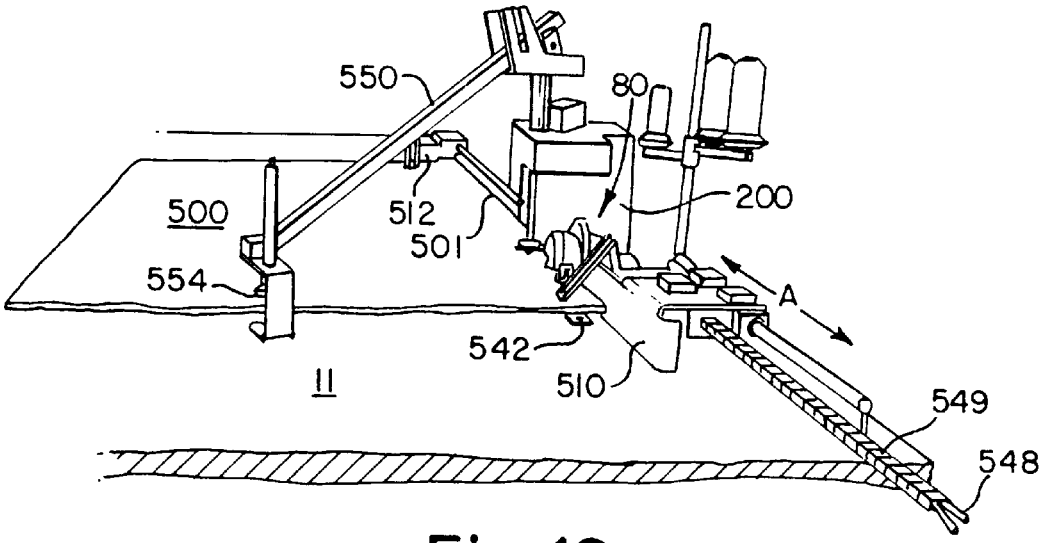
FIG. 18 is a partial, perspective view of the apparatus of FIG. 15 in yet another operating position.
Figure 19:
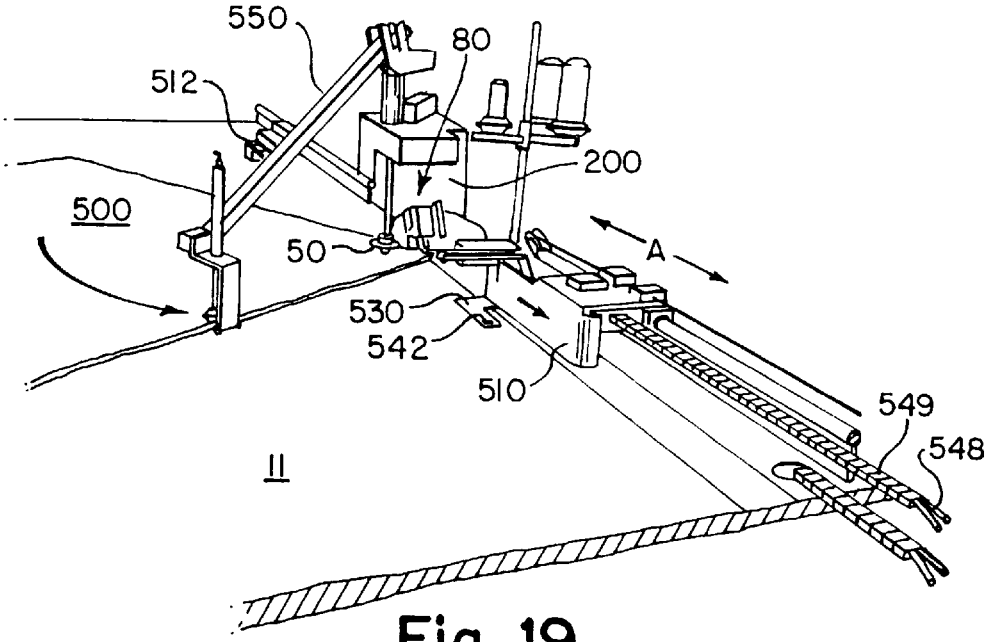
FIG. 19 is a partial, perspective view of the apparatus of FIG. 15 in yet another further operating position in which the panel is being rotated.
Figure 20:
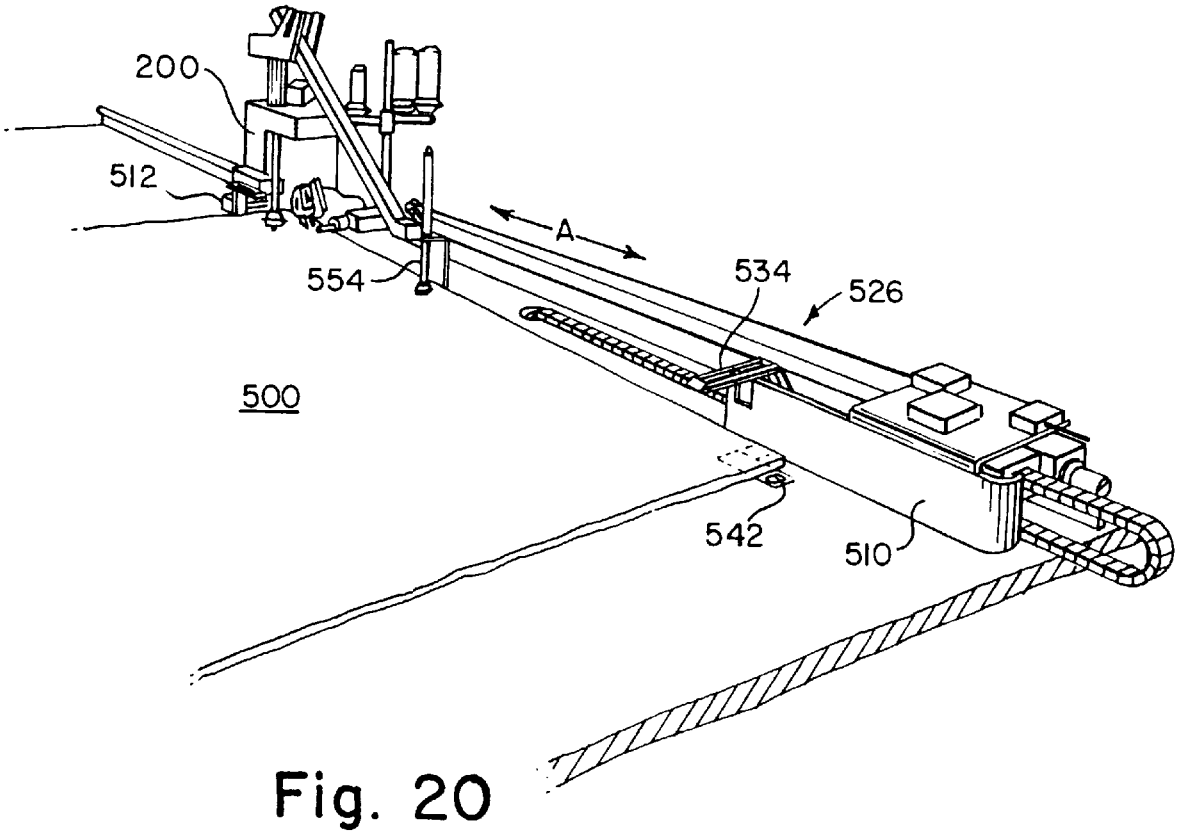
FIG. 20 is a partial, perspective view of the apparatus of FIG. 15 in yet another further operating position.

At this point, screw drive 572 is activated to return dolly 570 toward surface 11 so that needles 83 and 85 of stitcher 80 are in their home or sewing position along edge 501, as shown in FIGS. 17 and 23. Preferably, in its home position, cutter 81 is located ⅜ths of an inch in from edge 501 toward the center of panel 500, and needle 83 is positioned ¼th of an inch from cutter 81 while needle 85 is spaced ¾ths of an inch from needle 83. However, other distances may be used as desired. The operator manually pushes edge 501 into needles 83 and 85 of stitcher 80. If flange material is being sewn onto edge 501, the operator also inserts flange material beneath panel 500 and aligns it with edge 501 under needles 83 and 85 of stitcher 80 to begin the sewing process. If a side panel is being sewn onto panel 500, the side panel too would be manually aligned by the operator to make certain that an edge of the side panel is aligned with edge 501, and that the side panel is in the proper orientation. Using a foot pedal or other like switch, (not shown), the operator then begins to manually stitch the flange material or side panel or both to edge 501 of panel 500. Once the operator is satisfied that the stitching operation has commenced satisfactorily, the operator releases his or her foot from the pedal and pushes an "automatic" button. Thus begins the next automatic portion of the process.

During the entire stitching process, cutter 81 trims the edge of panel 500 and the flange material or side panel, even on the corners. All of the material outside the stitch produced by needle 83 is removed, which typically is ⅜" of material.

Figure 24:
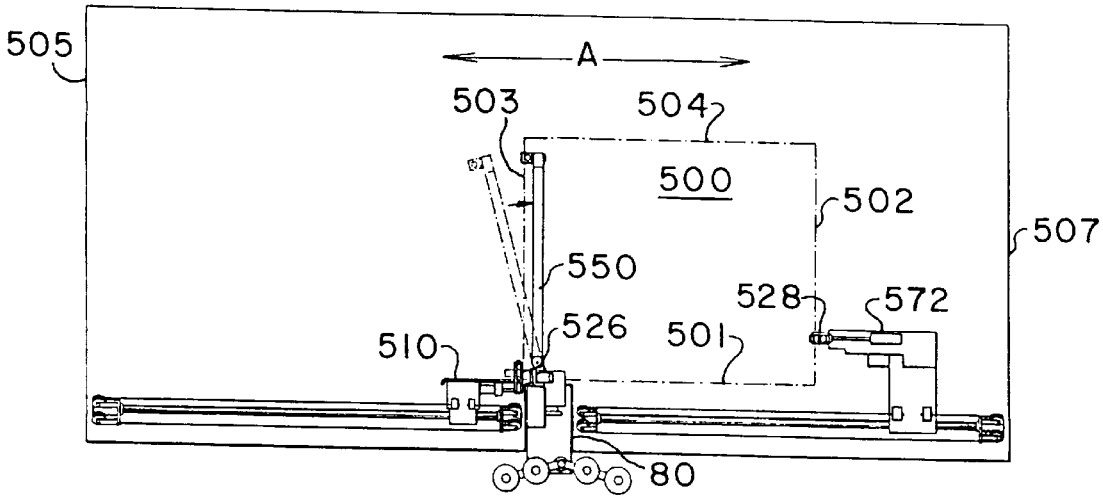
FIG. 24 is a top, schematic plan view of the apparatus of FIG. 9 showing the panel and the apparatus in yet another further operating position.

In the next automatic portion of the process, arm 55 initially pivots a short distance in a counter clockwise direction, as shown in FIG. 24, to be in the position shown in phantom in FIG. 24, in which arm 55 forms an angle of approximately 70° with respect to the true direction A. Stitcher 80 then automatically sews edge 501 of panel 500 to the other materials, such as a flange material or a side panel, until stitcher 80 approaches the corner of edges 503 and 501. Sensor 560 first detects the position of sled 510 in which edge 503 is about 5 to 6 inches from needles 83 and 85. A signal from sensor 560 causes controller 200 to slow the stitching pace from full speed to a jogging speed. In preferred embodiment, stitcher 80 operates at 3200 RPM's at full speed and once sled 510 is detected by sensor 560, stitcher 80 slows to about 400 RPM's. Stitcher 80 is now in what is known as the jog mode. Stitcher 80 continues in this jog mode until sensor 562 detects sled 510 which is the point at which the needles are disposed at the tangent point on edge 501, which typically is when edge 503 is about four inches from needles 83 and 85 of stitcher 80. At this point, stitcher 80 ceases stitching, and panel 500 is in the position shown in FIG. 24.

During this period of automatic stitching controller 200 measures the length of material being stitched, and the number of stitches to determine the stitch length. Knowing this quantity and the circumference of the corner, controller 200 knows how many stitches are required to stitch the corner. Controller 200 then coordinates movement of the elements of the system, including servo motors 518, 520, and **25*e* and stitcher 80, to make certain that while panel 500** is being pivoted, a clean symmetrical corner is stitched and cut and that the proper number of stitches are utilized to fully stitch the corner.

The next step involves automatic pivoting of panel 500. Pivot arm 50 drops into secure engagement with panel 500 adjacent to the corner of edges 501 and 503 to clamp panel 500 to surface 11. Either simultaneously therewith, or shortly thereafter, plate 552 of arm 550 is pivoted downwardly about fulcrum **20*a* onto surface 11 and arm 550 begins pivoting in a clockwise direction, as shown in FIG. 24, as plate 552 searches for edge 503. As sensor 558 of plate 552 detects edge 503, by passing under panel 500, cylinder 556 is activated to cause plunger 554 to drop as described, to clamp edge 503 against plate 552. Controller 200 then queries whether panel 500 is ready for pivoting. If the panel has been grabbed by plunger 554 and no other errors exist, the pivoting proceeds. If sensor 558 cannot find edge 503, the machine will stop, since the response to the query is negative. If there is an error, the operator may then correct the problem and push the appropriate button on control panel 207 to cause the pivoting of panel 500** to automatically proceed.

Figure 25:
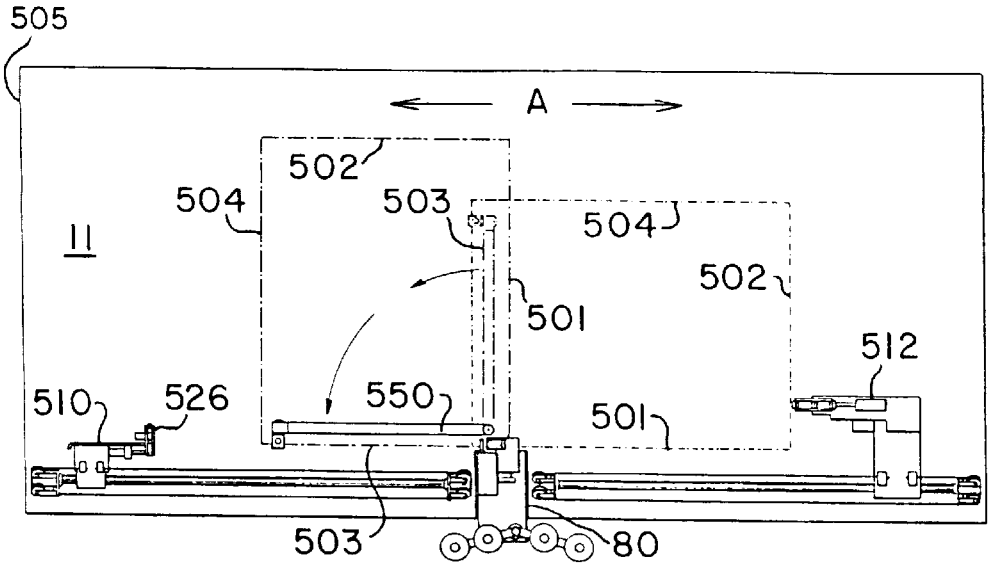
FIG. 25 is a top, schematic plan view of the apparatus of FIG. 9 showing the panel and the apparatus in yet another further operating position.
Figure 26:
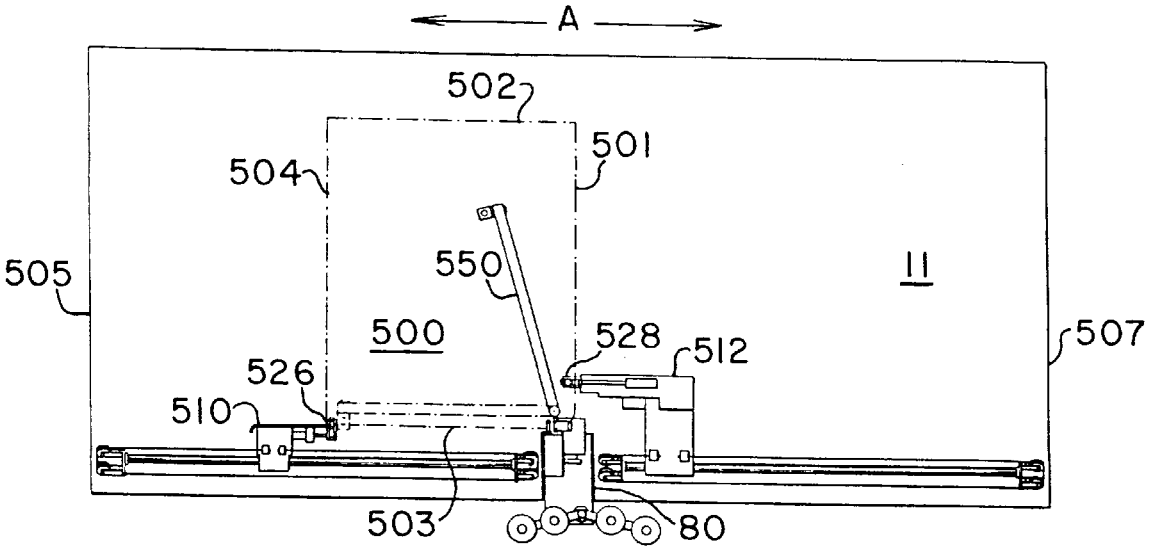
FIG. 26 is a top, schematic plan view of the apparatus of FIG. 9 showing the panel and the apparatus in yet another further operating position.

Thereafter, clamp 528 on sled 512 releases edge 502 by raising arm 536, and clamp 526 on sled 510 releases edge 501 by raising arm 534. Motor **25*e* then causes arm 550 to pivot in a counter clockwise direction, as shown in FIG. 25, pivoting panel 500 about arm 50 through a 90° angle until panel 500 is in the position shown in FIG. 25. Sled 512 then moves from right to left, as shown in FIG. 26, to its home position adjacent stitcher 80. Clamp 528 is then activated to grab edge 501. Plunger 554 is raised, and arm 550 is pivoted in a counter clockwise direction, as shown in FIG. 26, sufficiently to allow release of edge 503 from plunger 554 and plate 552. Thereafter, arm 550 is pivoted by cylinder 21 about fulcrum 20*a* to raise upwardly the end of arm 550 containing plunger 554. Arm 550 then is pivoted in a clockwise direction, as shown in FIG. 26, to return arm 550 to its home position, as shown as FIG. 26. Pivot arm 50 also is raised. Shortly, thereafter, sled 510 moves from right to left as shown in FIG. 26, searching for edge 504. As sensor 542 detects edge 504 by traveling past edge 504, edge 503 is clamped by clamp 526 adjacent edge 504 in the position shown in FIG. 26**. The automatic sewing process commences once again.

During the sewing process, servo motor 518 is not activated, but rotates freely. Servo motor 520 is activated to cause sled 512 to move from left to right, as shown in FIG. 21, along the true direction A. However, the sewing apparatus of stitcher 80 actually pulls panel 500 through stitcher 80 and controls the rate of movement of panel 500. Sled 512 merely tensions panel 500 by pulling on it to keep panel 500 from being caught or from bunching up within stitcher 80. Clutch 519 allows adequate slippage between servo motor 520 and system 516 to prevent panel 500 form being pulled through too quickly. Clutch 519 can be adjusted so that the desired tension is continually applied without pulling panel 500 through the stitcher too quickly.

Controller 200 counts the number of rotations of panel 500, and by so doing, controller 200 knows when edge 501 has again been reached.

As the process returns to edge 501, it should be recalled that only a portion of edge 501 was stitched initially, such as about the last 16 inches or so. Therefore, the remaining portion of edge 501 also must be stitched. If stitcher 80 were allowed to stitch edge 501 from beginning to end without adjustment, panel cutter 81 would cut off the previously stitched portion and produce an irregular edge which was trimmed twice where the stitches overlapped and only once where the stitching was fresh. To overcome this problem, when stitcher 80 returns to the starting point, for example 16 inches from edge 503, controller 200 automatically activates screw drive 572 to withdraw dolly 570 and thus needles 83 and 85 of stitcher 80 away from surface 11. The distance stitcher 80 is withdrawn equals the amount of material cut by cutter 81, such as ⅜ of an inch. Thus, as the starting point is reached along edge 501, the newly formed stitch coincides with the original stitch, and panel cutter 81 does not cut any material at all from panel 500 along edge 501 from the starting point to edge 503.

Figure 14:
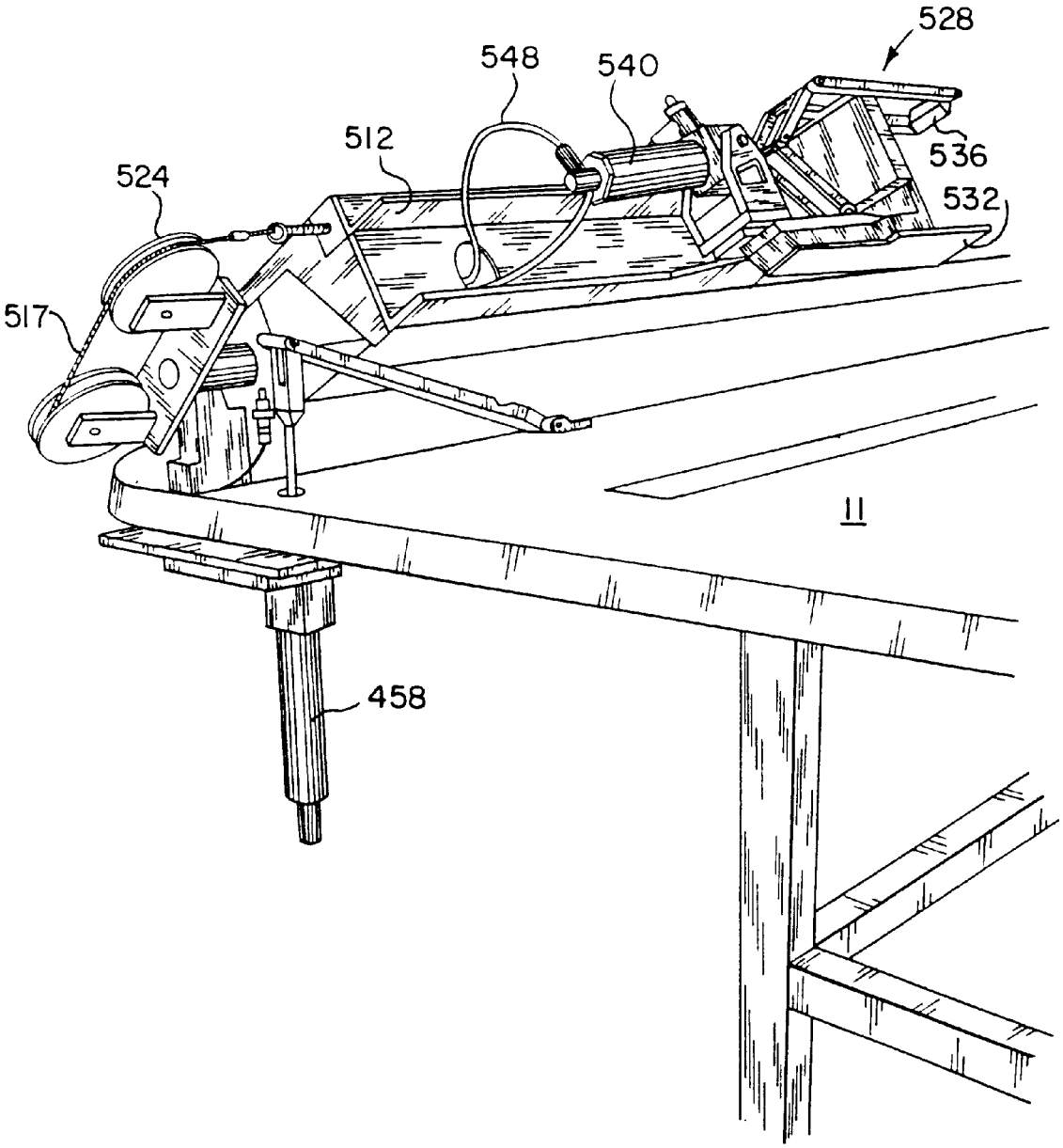
FIG. 14 is a partial, perspective view of the apparatus of FIG. 13 showing the sled in a raised position.
Figure 15:
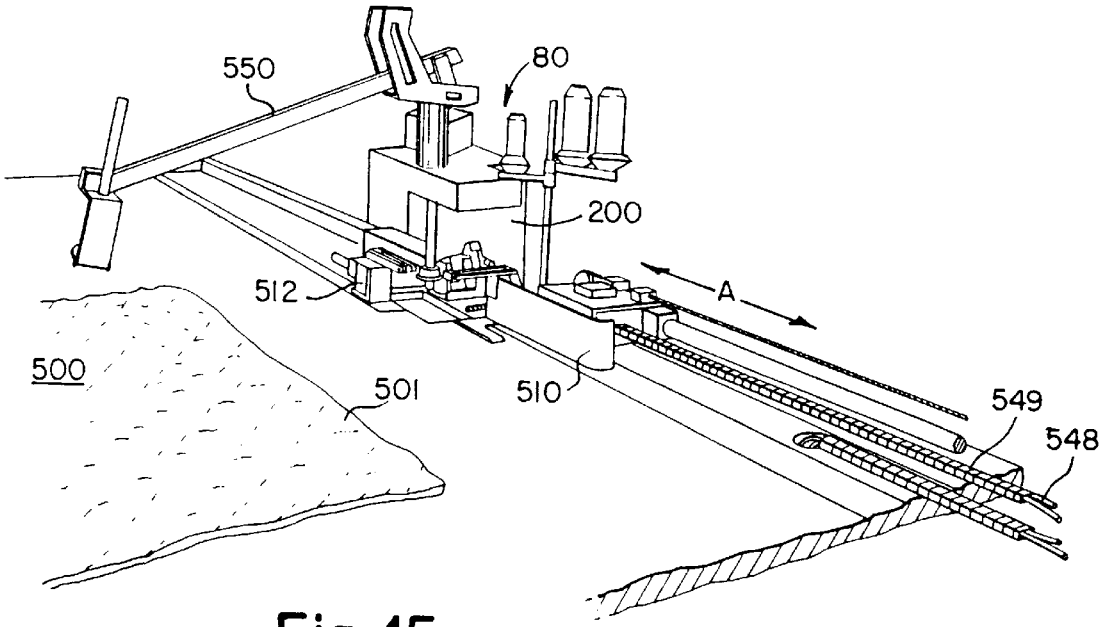
FIG. 15 is a partial, perspective view of the apparatus of FIG. 9 in which the sleds are in a home position.

Thereafter, panel 500 is not pivoted again. Instead, stitcher 80 continues to operate in a straight line, stitching off edge 503 of the panel as sled 512 continues to pull panel 500 to the right as shown in FIG. 24 and as clamp 526 on sled 510 is deactivated to release panel 500. Preferably stitcher 80 is in its jog mode during the last four inches before edge 503, as detected by sensor 562. Once edge 503 passes needles 83 and 85 of stitcher 80, as determined by controller 200, stitcher 80 is deactivated and flange cutter 95 is activated to sever the flange material (if necessary) along a line parallel to edge 503. Once the flange material has been cut, sled 512 resumes its travel to the right as shown in FIG. 24. Once sled 512 reaches a home position adjacent pulley 524, sled 512 stops and cylinder 540 is deactivated to release edge 502 of panel 500. Sled 512 then is tilted in an upward position by cylinder 458 to release panel 500, as shown in FIG. 14. At this point, panel 500 is removed from surface 11 either manually by the operator or automatically using other equipment.

It is to be noted that any time where stitching is commenced after it has stopped, preferably stitcher 80 is operated in the jog mode for a short period of time to begin the stitching process. Thereafter stitcher 80 automatically switches into its full operating speed. This step is done so that the stitching process begins smoothly and does not snag or produce other errors.

It is to be understood that controller 200 may be programmed to change any of the variables, depending on the particular application. For example, the tangent point can be changed from four inches from an edge to some other number. In addition, the speed at which the panel is pivoted can be adjusted. Typically, arm 550 takes two seconds to pivot panel 500 through an angle of 90°. However, this pivoting can be done either more quickly or more slowly as desired. Also, the jog mode can be set at any RPM selected by the operator. Finally, the period of time or the number of stitches during which the jog mode is utilized in both beginning the stitching process and upon approaching a tangent point can be adjusted.

The controller utilized for this purpose is a conventional multi axis commercial type controller which can be programmed in a known manner by one of ordinary skill in the art.

To achieve high quality sizing, other aspects of the invention, as described below, accurately feed the top panel to the stitcher. More particularly, mechanisms 60 and 70 are provided for monitoring the orientation of the top panel, and mechanism 30 is provided for adjusting the orientation, if misalignment occurs.

Referring to FIGS. 1, 6 and 7 conjointly, a shoe 60 is pivotally mounted and spring biased to engage the edge 301 of the top panel that is being joined. The biasing force is sufficient to retain contact with the edge, but not enough to cause bunching or movement of the panel. As such, the shoe 60 follows the longitudinal orientation of the edge.

The shoe 60 includes a jog 61 that acts as a photo mask. A detector array 70 is disposed to monitor the jog 61. The array 70 includes photo emitting 70*a* and detecting mechanisms 70*b*, with the jog 61 placed therebetween. The initial position 71 of jog 61 is centered in the array 70. Thus, if the shoe 60 moves because the materials are fed at an angle relative to true direction A, detector array 70 detects more or less optical energy than that detected when the material is fed at a true direction A. As such, array 70 provides a signal indicative of the amount and direction of misorientation.

Alternative orientation detection techniques are known. In addition, for certain materials, particularly unfilled materials, a detector array may be used without a shoe apparatus. In these arrangement, the material, rather than the shoe, may act as a mask for the photo-detecting arrangement.

To adjust the orientation of the top panel, a correction wheel 30 is provided. Referring to FIGS. 1 and 2 conjointly, the correction wheel includes a receiving wheel 30*a* that may engage the panel as described below. By varying the rotational speed of the receiving wheel 30*a*, a torque may result from the force of the receiving wheel and the force of the stitcher's feeding mechanism. This torque causes the top panel to pivot slightly and may be used to correct the orientation of the top panel. The receiving wheel 30*a* is in transverse alignment with the needle, relative to direction A, so that the panel may be rotated into alignment about the needle. Thus, the panel will not be pulled from the needle.

Figure 2:
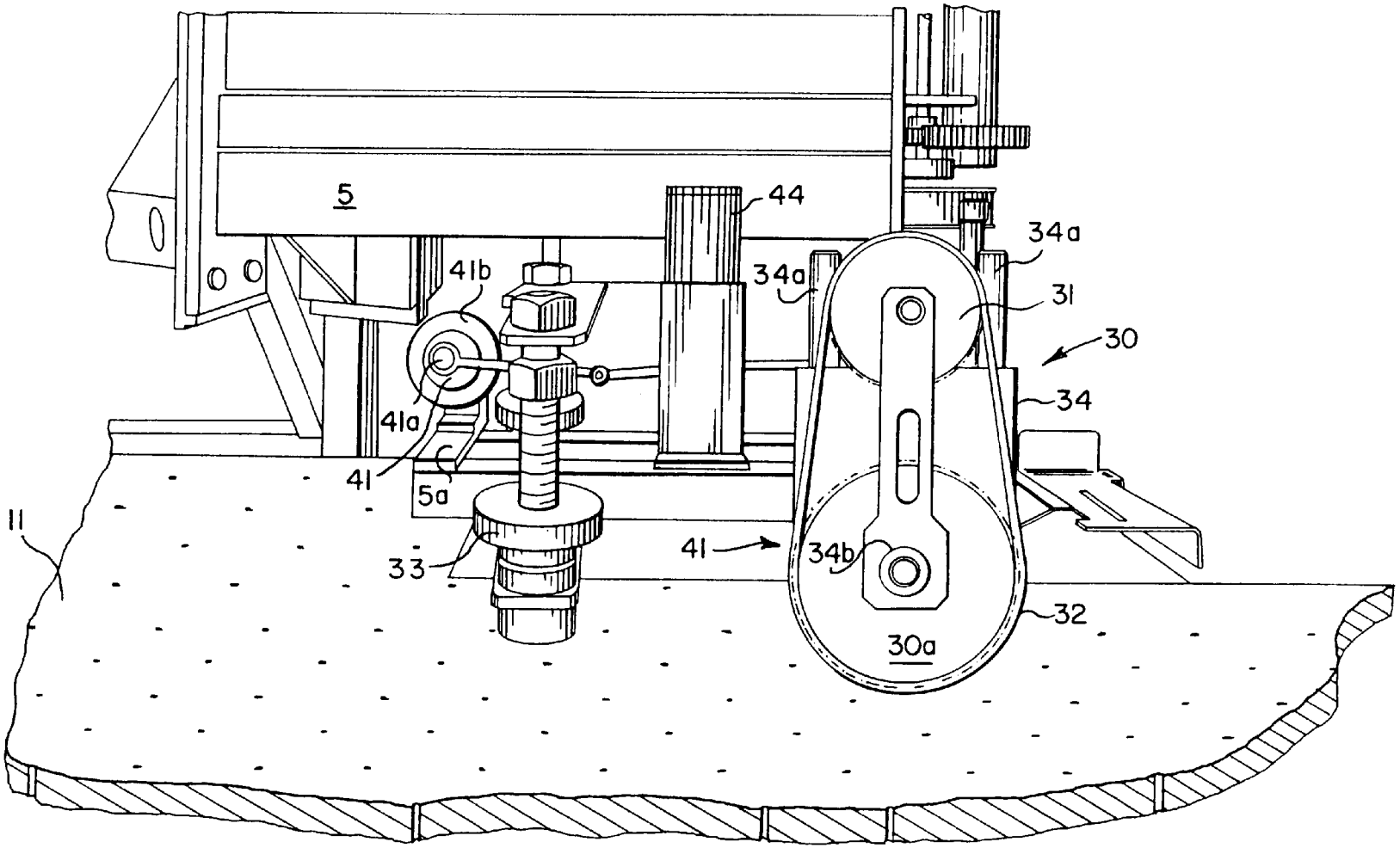
FIG. 2 is a side view of the apparatus of FIG. 1, including the correction wheel.

Referring to FIG. 2, the correction wheel includes a receiving wheel 30*a*, a drive wheel 31, and a belt 32. The receiving wheel 30*a* and the drive wheel 31 are connected by a member 34*b*, the combination 41 being attached to pneumatic lifter 34. The lifter 34 is raised or lowered on guide posts 34*a*, under the control of the controller 200. Vertical adjusters 33 are used to calibrate platform 5*a*, which holds the combination 41, in relation to frame 5. In this fashion, the combination 41 may be calibrated for different thickness panels. Drive wheel 31 is driven by a drive train 100, described below. Receiving wheel 30*a* is connected to drive wheel 31 via a belt 32, which in a preferred embodiment is rubberized and toothed. Belt 32 both connects the respective wheels and also provides a soft, yet firm grip on the top panels.

Figure 4A:
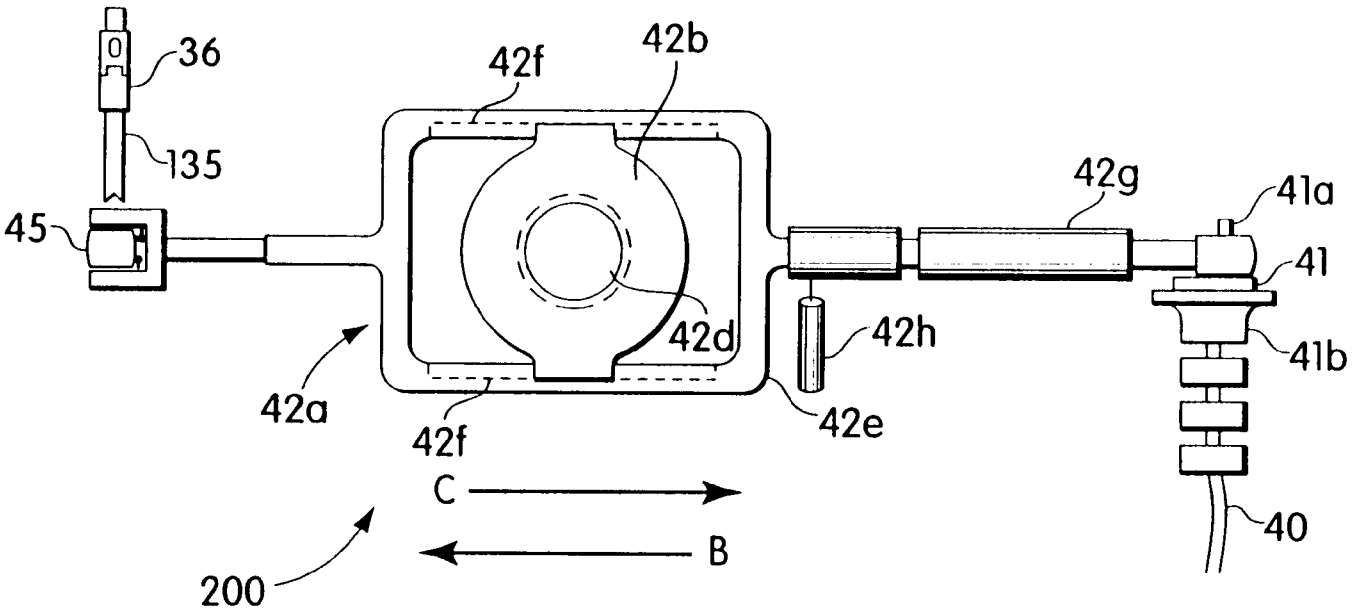
FIG. 4A is a top planar view which illustrates the drive train of the correction wheel.
Figure 4B:
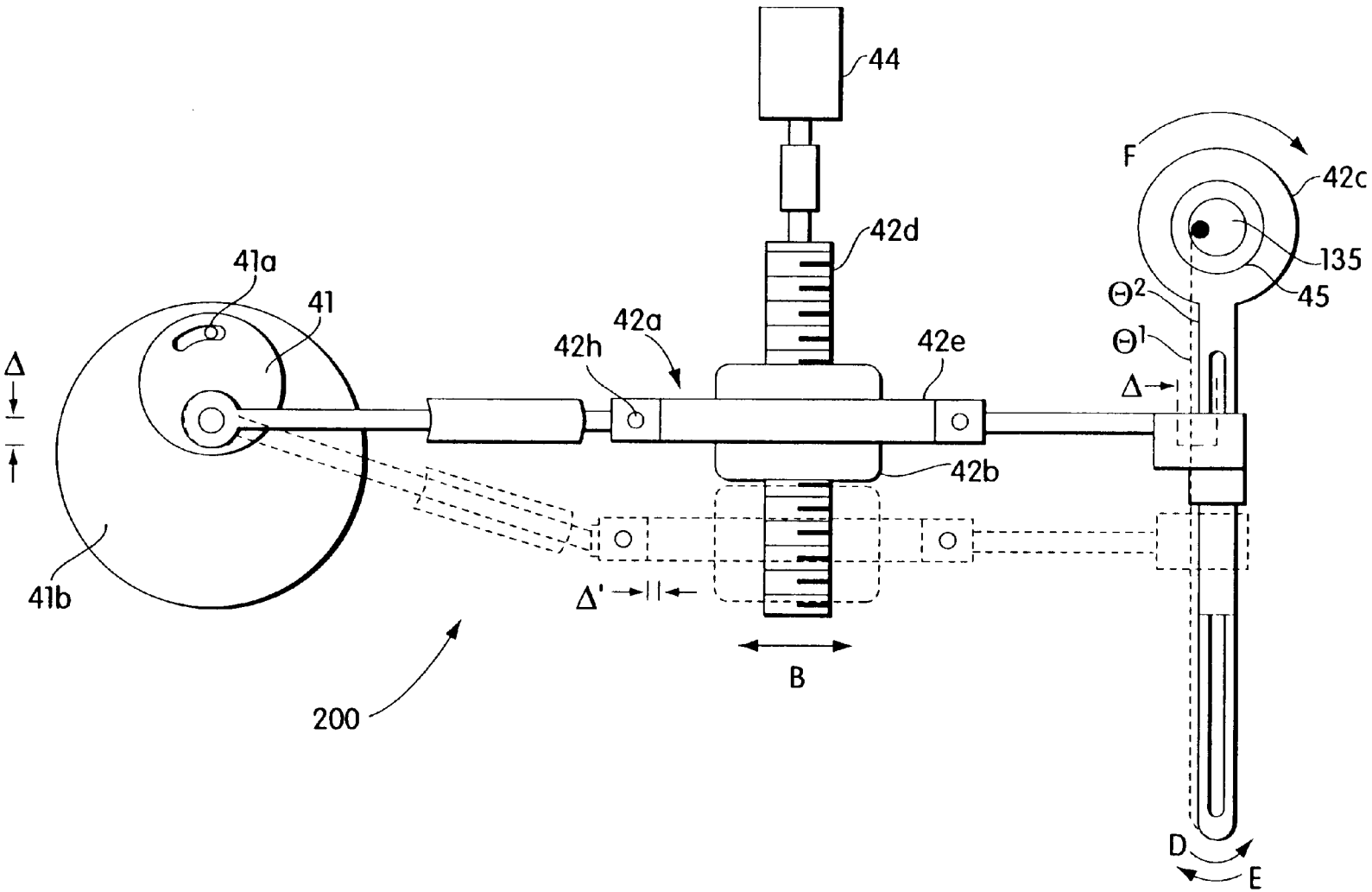
FIG. 4B is a side elevational view which illustrates the drive train of FIG. 4A.

Drive train 100 is mechanically coupled to a main shaft (not shown) of the conventional stitcher 80. In this fashion, the correction wheel 30 may be kept in synchronism with the feeding mechanism of the stitcher. Referring to FIGS. 4A–4B conjointly, drive train 100 includes flexible drive 40, main disk 41*b*, eccentric gear 41, carriage 42*a*, clutch 45, drive shaft 135, and universal 36. Flexible drive 40 is attached to the main shaft of the conventional stitcher, with known techniques. The other end of the flexible drive 40 is connected to a main disk 41*b* to which eccentric gear 41 is attached off center. The off center attachment causes pin 41*c* to move about the center of disk 41*b*. This causes the carriage 42*a* to rock back and forth, as indicated by B and C. For example, if the gear 41 is positioned off center 3/16 of an inch by adjusting pin 41*a*, the carriage will rock 3/8 of an inch (3/16 of an inch plus 3/16 of an inch). Carriage 42*a* has an opening with channels 42*f* for holding a fixed nut 42*b*. The channels 42*f* extend for substantially the length of carriage frame 42*e*. Carriage 42*a* rocks in direction of arrows B–C, while the nut 42*b* is held vertically stationary and slides within carriage 42*a*.

A carriage arm 42*g* is pivotally attached by pin 42*h* to frame 42*e*. The other end of carriage 42*a* is slidably attached to rocker arm 42*c*. Rocker arm 42*c* is caused to rock in direction of arrows D–E by the rocking motion of carriage 42*a*. In addition, rocker arm 42*c* is attached to a one-way clutch, such as a Torrington clutch 45, which receives the rocking motion D–E and translates it into a rotational motion in the direction shown by arrow F. The rotational speed is proportional to the speed of rocking motion D–E. Thus, the rotation of the main shaft (not shown) is translated into a rotational motion F at the output of clutch 45.

The nut 42*b* is engaged with a lead screw 42*d*, which is attached to electric stepper motor 44, controlled by the controller 200. Thus, controller 200 causes the lead screw to rotate, thus raising or lowering the nut 42*b* and the carriage 42*a*. See phantom of FIG. 4B for example alternative position of carriage 42*c*. By raising or lowering the carriage 42*a*, the amount of angular rotation of the rocker arm 42*c* is affected. By lowering the carriage 42C a smaller angular rotation $\theta_2$ is covered in the same time as above for $\theta_1$. Consequently, the controller changes the rotational speed at the output of clutch 45 by stepper motor 44. Drive wheel 31 is driven by a drive shaft 135, which is attached to the output of clutch 45.

Shaft 135 includes universal 36 to allow the correction wheel 30 to be raised and lowered relative to the working surface 11. The correction wheel 30 is pneumatically raised or lowered by pneumatic lifter 34, as described above. The wheel 30 is placed in the lowered state, during the stitching operation, so that the panel may be adjusted. The wheel 30 is placed in the raised state, during the turning operation, so that the panel may be rotated freely without friction from the receiving wheel 30*a*.

Correction wheel 30 corrects any misalignment of the edge of the top panel by having the speed of the receiving wheel 30*a* appropriately adjusted. As a result, even if the top panel 305 is slightly misrotated by the mover arm 20, i.e., to something other than 90°, correction wheel 30 may adjust the panel.

The method of correcting the orientation will be described with reference to FIGS. 1, 2, and 4A–B. The panel is pulled toward stitcher 80 by a feed mechanism (not shown) of the stitcher and by a receiving wheel 30*a* engaged with the top panel 305. The receiving wheel 30*a* is mechanically coupled to a main shaft of the sewing machine and thus rotates, in synchronism with the feeding mechanism. The longitudinal orientation of the top panel 305 is monitored by a detector mechanism 60 and 70. In response thereto, the mechanical coupling of the receiving wheel 30*a* is modified to appropriately increase or decrease the rotational speed of the receiving wheel 30*a*. The resulting torque, caused by the receiving wheel 30*a* and the feeding mechanism of the stitcher, causes the panel to rotate into alignment.

Depending on the type of panel used, polyfil or the like may protrude from the ticking layer of the panel 305. To flatten the edge 301 before the edge is eventually sewn, and in the process urge any protruding fill outwardly, a panel flattening apparatus 90 is provided. Referring to FIG. 6, panel flattener 90 is disposed prior to the needle 83, using a spring mount 91 which is provided to absorb vibrations. A pneumatic lifter 92*a* (see FIG. 1) is used to raise the flattener 90 to ease initial loading of a panel into the invention. Alternatively, the lifter 92*a* may be used to replace the spring mount by acting as an air spring. The flattener 90 is attached to the main shaft (not shown) with a flexible drive 92 so that it may synchronously rotate as shown by arrow G, as a counter to the feeding direction of the materials (see FIG. 7). In a preferred embodiment, flattener 90 has an auger-like shape, so that the screw-like edges and rotation may flatten the material and urge any fill toward the outer edge, where it may be eventually cut by a panel cutter 81. Alternatively, the flattener 90 may be a helical, wedge-shaped brush, or use similar helical structures.

In view of the above description, it is likely that modifications and improvements will occur to those skilled in the art, which should be deemed as being within the scope of this invention. The above description is intended to be exemplary only, the scope of the invention being defined by the following claims and their equivalents.

What is claimed is:

1. A machine for sewing together a first panel and a second panel, said machine comprising:

a sewing machine for receiving along a feed direction and joining together the first and second panels;

an arm having a longitudinal axis and being arcuately moveable about a fulcrum towards a surface of the first panel, a distal end of the arm being adapted to contact the surface of the first panel as the arm moves toward the surface of the first panel;

means for rotating the arm about an axis normal to the surface of the first panel to rotate the first panel when the distal end of the arm is in contact with the surface of the first panel;

a shoe biased to follow an edge of the first panel as the first panel is fed to the sewing machine;

a detector to monitor the shoe and provide a signal indicative of a longitudinal orientation of the edge of the first panel; and means for adjusting the longitudinal orientation of the first panel with respect to a true feed direction in response to the longitudinal orientation signal, the adjusting means including a receiving wheel engageable with the first panel, the receiving wheel being in alignment with the sewing machine along a direction transverse to the true feed direction.

2. The machine of claim 1, wherein the adjusting means further includes means for rotating the receiving wheel, the rotating means being coupled to a main shaft of the sewing machine and including means for varying a rotational speed of the receiving wheel.

3. A method for automatically sewing together a first fabric panel and a piece of material, the method comprising the steps of:

manually placing the first fabric panel and the piece of material on a worktable adjacent a sewing machine in a predetermined location;

automatically feeding the first panel and piece of material to the sewing machine in the feed direction;

sewing together the first panel and the piece of material along one edge of the first panel;

detecting a corner of the first panel at a first predetermined distance from the sewing machine;

in response to said detecting step pivoting the first panel about the corner;

during said pivoting step, continually automatically sewing the first panel to the piece of material along an edge of the first panel; and cutting the corner of the first panel during said step of continually automatically sewing.

4. The method as recited in claim 3 further comprising the steps of:

prior to said detecting step, detecting the corner of the first panel at a second predetermined distance from the sewing machine, the second predetermined distance being greater than the first predetermined distance; and in response to detecting the corner of the first panel at the second predetermined distance, slowing the stitching speed of the sewing machine until completion of said pivoting step.

5. A machine for sewing together a first panel and a second panel, said machine comprising:

a sewing machine for receiving along a feed direction and joining together the first and second panels;

an arm having a longitudinal axis and being arcuately moveable about a fulcrum towards a surface of the first panel, a distal end of the arm being adapted to contact the surface of the first panel as the arm moves toward the surface of the first panel;

apparatus for rotating the arm about an axis normal to the surface of the first panel to rotate the first panel when the arm is in contact with the surface of the first panel;

a controller;

a first detector positioned a first fixed distance before the sewing machine along the feed direction for providing a first signal to the controller when the first detector detects a corner of the first panel, the controller causing the sewing machine to reduce its stitching speed in response to the first signal;

a second detector positioned a second fixed distance before the sewing machine along the feed direction for providing a second signal to the controller when the second detector detects a corner of the first panel, the controller causing the rotating apparatus to rotate the first panel in response to the second signal; and a second pivot arm engageable with the surface of the first panel in a position proximal to the sewing machine with respect to the distal end of the arm to provide a pivot point for rotation of the first panel, a second pivot arm engaging the surface of the first panel in response to the second signal.

6. A machine for sewing together a fabric panel and a piece of material, said machine comprising;

a sewing machine for receiving along a feed direction and joining together the fabric panel and the piece of material;

a mechanism disposed after the sewing machine in the feed direction and including a clamp for grasping a forward edge of the fabric panel with respect to the feed direction and for pulling the fabric panel linearly in the feed direction past the sewing machine;

apparatus for detecting the position of a trailing edge of the fabric panel with respect to the feed direction, the clamp releasing the forward edge of the fabric panel when the trailing edge of the fabric panel is in a predetermined position with respect to the sewing machine; and apparatus including an arm for rotating the fabric panel around a corner of the fabric panel.

7. The machine as recited in claim 6 further comprising apparatus for selectively moving the grasping and pulling mechanism in the feed direction and in a direction parallel to and opposite of the feed direction, the moving apparatus moving the grasping and pulling mechanism toward the fabric panel after rotation of the fabric panel to allow the clamp to grasp an edge of the fabric panel.

8. The machine as recited in claim 7 further comprising a slip clutch disposed between the moving apparatus and the grasping and pulling mechanism.

9. The machine as recited in claim 7 wherein the moving apparatus is powered separately from the sewing machine.

10. The machine as recited in claim 6 wherein said grasping and pulling mechanism includes apparatus for sensing an edge of the fabric panel.

11. A machine for sewing together a fabric panel and a piece of material, said machine comprising:

a generally planar table having a frame for supporting the fabric panel;

a sewing machine for joining together the fabric panel and the piece of material;

apparatus for feeding the fabric panel to and past the sewing machine in a feed direction;

a dolly disposed in sliding contact with the frame of the table and supporting the sewing machine; and a drive mechanism for moving the sewing machine and dolly selectively toward and away from the table in a direction generally perpendicular to the feed direction and generally parallel to the plane of the table to allow proper placement of the sewing machine with respect to an edge of the fabric panel.

12. A machine for sewing together a fabric panel and a piece of material, said machine comprising:

a table for supporting the fabric panel;

a sewing machine for joining together the fabric panel and the piece of material in a sewing process;

apparatus for feeding the fabric panel to and past the sewing machine in a feed direction;

a drive mechanism for moving the sewing machine selectively toward and away from the table in a direction generally perpendicular to the feed direction to allow proper placement of the sewing machine with respect to an edge of the fabric panel; and a sharpened edge disposed in association with the sewing machine for trimming a strip off an edge of the panel in conjunction with the sewing process, a width of the strip being trimmed being adjusted by operation of the drive mechanism.

13. A machine for sewing together a fabric panel and a piece of material, said machine comprising:

a generally planar table for supporting the fabric panel;

a sewing machine for joining together the fabric panel and the piece of material;

apparatus for feeding the fabric panel to and past the sewing machine in a feed direction;

a drive mechanism for moving the sewing machine selectively toward and away from the table in a direction generally perpendicular to the feed direction and generally parallel to the plane of the table to allow proper placement of the sewing machine with respect to an edge of the fabric panel; and apparatus including an arm for rotating the fabric panel after sewing along one edge of the panel to place another edge of the panel in position to be sewn.

14. A method for joining together a fabric panel with a piece of material along edges of the fabric panel, said method comprising the steps of:

feeding the fabric panel and the piece of material to a sewing machine in a feed direction;

sewing together the fabric panel and the piece of material at a position spaced a predetermined distance from an edge of the panel beginning at a first location;

rotating the panel about a corner after said sewing step has been completed along the first edge of the panel;

sewing together the fabric panel and the piece of material along another edge of the panel;

simultaneously with said sewing steps, cutting with a cutter a strip of a predetermined width from the edge of the fabric panel, the predetermined width being less than the predetermined distance;

completing said sewing steps by returning the sewing machine to the first location; and withdrawing the sewing machine and cutter from the fabric panel in a direction generally transverse to the feed direction as the sewing machine approaches the first location, to prevent cutting of a strip of the predetermined width after return of the sewing machine to the first location.

15. A machine for sewing together a fabric panel and a piece of material, said machine comprising:

a sewing machine for receiving and joining the fabric panel to the piece of material along edges of the fabric panel;

apparatus for feeding the fabric panel and the piece of material to the sewing machine in a desired feed direction;

a receiving wheel for engaging a surface of the fabric panel, the receiving wheel being in alignment with the sewing machine along a direction generally transverse to the desired feed direction but spaced from the sewing machine;

a drive for rotating the receiving wheel, the drive being mechanically coupled to a main shaft of the sewing machine; and apparatus including an arm for engaging the first panel for rotating the first panel around a corner of the panel as the corner of the panel approaches and passes through the sewing machine.

16. A machine for sewing together a fabric panel and a piece of material, said machine comprising:

a sewing machine for receiving in a feed direction and joining together the fabric panel and the piece of material;

an edge flattener disposed prior to the sewing machine in the feed direction of the fabric panel and including a component rotatable about an axis of rotation; and a pneumatic cylinder for holding said edge flattener in position with respect to the fabric panel.

17. The machine as recited in claim 11 wherein said drive mechanism comprises:

a screw drive coupled to said dolly.

18. A machine for sewing together a fabric panel and a piece of material, said machine comprising:

a sewing machine for receiving along a feed direction and joining together the fabric panel and the piece of material;

apparatus for rotating the fabric panel about a corner of the fabric panel, said rotating apparatus comprising:

a pivot for engaging the corner of the fabric panel to hold the corner of the fabric panel in position and to permit the fabric panel to pivot thereabout;

an arm for engaging the fabric panel at at least one point spaced from said pivot; and apparatus for rotating said arm about said pivot.

19. The machine as recited in claim 18 further comprising:

a controller;

a first detector positioned a first fixed distance before said sewing machine along the feed direction for providing a first signal to said controller when said first detector detects the corner of the fabric panel, said controller causing said sewing machine to reduce its stitching speed in response to the first signal; and a second detector positioned a second fixed distance before said sewing machine along the feed direction for providing a second signal to said controller when said second detector detects the corner of the fabric panel, said controller causing said rotating apparatus to rotate the fabric panel in response to the second signal.

20. The machine as recited in claim 11 wherein the drive mechanism is independent of a sewing machine drive.

21. A machine for sewing a piece of material comprising:

a sewing machine for receiving the piece of material in a feed direction;

an edge flattener disposed prior to the sewing machine in the feed direction of the fabric panel and including a generally cylindrical component which engages the piece of material rotatable about an axis of rotation;

a motor for rotating the cylindrical component about its axis of rotation in a direction such that the component engages the piece of material in a direction opposite of the feed direction; and apparatus for holding the edge flattener in position with respect to the piece of material.

* * * * *